US007059793B2

(12) United States Patent
Mori et al.

(10) Patent No.: US 7,059,793 B2
(45) Date of Patent: Jun. 13, 2006

(54) PRINTER AND CUTTER

(75) Inventors: Yukihiro Mori, Shinagawa (JP); Masahiro Tsuchiya, Shinagawa (JP); Sumio Watanabe, Shinagawa (JP); Fumio Sakurai, Shinagawa (JP); Kunihiko Funada, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 35 days.

(21) Appl. No.: 10/765,922

(22) Filed: Jan. 29, 2004

(65) Prior Publication Data

US 2004/0184863 A1 Sep. 23, 2004

(30) Foreign Application Priority Data

Feb. 5, 2003 (JP) ..... 2003-028725

(51) Int. Cl.
*B41J 11/66* (2006.01)
*B41J 11/70* (2006.01)

(52) U.S. Cl. ..... 400/621; 400/611; 400/613; 400/693

(58) Field of Classification Search ..... 400/621
See application file for complete search history.

(56) References Cited

U.S. PATENT DOCUMENTS

| | | | | |
|---|---|---|---|---|
| 5,717,836 | A | 2/1998 | Horie | 358/1.1 |
| 5,749,277 | A | 5/1998 | Walker | 83/563 |
| 5,974,930 | A | 11/1999 | Longrod | 83/629 |
| 5,993,093 | A | 11/1999 | Schoennauer et al. | 400/621 |
| 6,155,731 | A * | 12/2000 | Bertalan et al. | 400/621 |
| 6,408,727 | B1 | 6/2002 | Harris et al. | 83/566 |
| 6,503,009 | B1 * | 1/2003 | Naitou | 400/621 |
| 6,831,670 | B1 * | 12/2004 | Fujiwara | 347/222 |
| 2003/0156882 | A1 * | 8/2003 | Song | 400/621 |
| 2003/0198499 | A1 * | 10/2003 | Tsuchiya et al. | 400/621 |

FOREIGN PATENT DOCUMENTS

| | | |
|---|---|---|
| EP | 1 095 782 A2 | 5/2001 |
| JP | 2000-61881 | 2/2000 |
| JP | 2000-118060 | 4/2000 |
| JP | 2000-355128 | 12/2000 |
| JP | 2001-302073 | 10/2001 |

* cited by examiner

*Primary Examiner*—Daniel J. Colilla
(74) *Attorney, Agent, or Firm*—Staas & Halsey LLP

(57) ABSTRACT

A printer with automatic cutter, provided with a built-in type cutting section. The printer includes a printing section, a cutting section arranged downstream of the printing section in a paper feeding direction, a support mechanism for supporting the printing section and the cutting section, and a drive source provided in the cutting section. The printing section acts to provide a print to printing paper fed continuously thereto. The cutting section includes a fixed blade and a movable blade which cooperate with each other to cut the printing paper, the fixed blade and the movable blade being shiftable relative to each other between a cooperative mutually-adjoining position and an uncooperative mutually-remote position. The support mechanism includes a first support member supporting the fixed blade of the cutting section and a second support member supporting the movable blade of the cutting section, the first support member being fixedly arranged to specify an operative printing point in the printing section and the second support member being shiftably arranged relative to the first support member. The drive source generates a driving force to move the movable blade on the second support member, the drive source being mounted on the first support member.

19 Claims, 14 Drawing Sheets

PRINTER AND CUTTER

BACKGROUND OF THE INVENTION

1. Field of the Invention

The present invention generally relates to a printing system, and particularly to a printer provided with a cutting section for automatically cutting a continuous printing paper or web. The present invention also relates to a cutter capable of being incorporated in a printer.

2. Description of the Related Art

In conventional printers, a cutting section is provided for automatically cutting a printing paper or web, after a printing section prints on printing paper continuously fed thereto, so as to cut off a printed length from an unprinted length. Such a printer with automatic cutter has been widely used as a printer adapted to be incorporated in a cash register, a portable terminal unit, and so on, wherein the cutting section is generally provided with a fixed blade and a movable blade, which cooperate with each other to cut a printing paper or web, and a drive mechanism for driving the movable blade for a cutting operation. In particular, it is conventional for a paper cutter as a self-contained apparatus, which is provided with a fixed blade and a movable blade unit including a movable blade and a blade drive mechanism, to be arranged downstream of the printing section of the printer as seen in a paper feeding direction.

In the conventional printer with automatic cutter, an openable/closable frame structure (generally called as a clamshell structure) is used, which includes a first frame member carrying a roll-type printing paper or web and a second frame member joined relatively pivotably with the first frame member and cooperating with the first frame member to define a web receiving space, and the movable blade of the cutting section is disposed on the first frame member as a stationary member, while the fixed blade of the cutting section is disposed on the second frame member as an openable/closable member (see, e.g., Japanese Unexamined Patent Publication (Kokai) No. 2000-61881 (JP2000-61881A)). In this known printer, the fixed blade and the movable blade in the cutting section are arranged to be shiftable relative to each other between a cooperative mutually-adjoining position (where the cutting operation can be performed) and an uncooperative mutually-remote position.

The clamshell structure as described above has been used in a thermal printer, provided with a heat-sensitive printing section including a thermal head and a platen, to facilitate the supply or exchange of a printing web (or a heat-sensitive paper). For example, in the printer as described in JP2000-61881A, the thermal head is mounted on the first frame member as a stationary base for carrying the web, while the platen is mounted on the second frame member as a pivoted cover for opening or closing the web receiving space, so as to constitute an openable/closable printing section. In this arrangement, the first frame member is fixedly or stationarily placed to specify an operative printing point, and the second frame member is shiftably or pivotably placed in relation to the operative printing point. The movable blade unit including the movable blade in the cutting section is disposed on the first frame member in close proximity to the thermal head and downstream of the thermal head as seen in the paper feeding direction, and the fixed blade in the cutting section is disposed on the second frame member in close proximity to the platen and downstream of the platen as seen in the paper feeding direction.

The thermal printer including the openable/closable printing section has an advantage in that a new printing paper or web as supplied or exchanged is readily set into a stand-by state by opening the frame members to make the thermal head and the platen fully remote from each other, then placing a leading end length of the printing paper along the thermal head or the platen, and thereafter closing the frame members. Also, the printer of JP2000-61881A has a further advantage in that, since the fixed blade and the movable blade in the cutting section are located at the mutually-remote position by opening the frame members and thereafter located at the mutually-adjoining position by closing the frame members, the leading end length of the printing paper is readily placed between the fixed and movable blades.

Conventionally, the cutting section of the printer with automatic cutter is constituted such that the fixed blade is disposed in closer proximity to the printing section than the movable blade (i.e., disposed at the inner side of the movable blade) when the fixed and movable blades are in the mutually-adjoining position, as described in JP2000-61881A. According to this blade arrangement, the unprinted length of the printing paper after being cut by the cutting section can stand by for a subsequent printing process in a condition where the leading end of the cut unprinted length is placed adjacent to the cutting edge of the fixed blade. In particular, in the case where the printing web is used, the remaining curl of the web tends to facilitate placing of the leading end of the cut unprinted web adjacent to the cutting edge. When the leading end of the cut unprinted paper is placed adjacent to the cutting edge, interference between the leading end and the fixed blade upon starting a subsequent printing process can be avoided, and thus the printing process can proceed smoothly.

As explained above, the conventional printer with automatic cutter is generally provided with the movable blade unit as a self-contained apparatus, which serves as the movable blade in the cutting section and is arranged downstream of the printing section as seen in the paper feeding direction. The movable blade unit generally has a relatively large outside dimension, which may make it difficult to reduce the overall size of the printer.

Also, as explained above, the conventional printer adopting the clamshell structure is constituted such that the fixed blade mounted on the second frame member as a pivoted cover is disposed inside of the movable blade mounted on the first frame member as a stationary base, when the fixed and movable blades are in the mutually-adjoining position. Thus, in the case where the printing paper becomes unintentionally jammed between the fixed blade and the movable blade during a paper cutting process to cause the malfunction of the movable blade, it is difficult to pivotally shift the second frame member relative to the first frame member while in the jamming condition, because the movable blade lies adjacent to the outside of the fixed blade. Therefore, in order to eliminate the jamming condition, it is necessary to forcibly retract the movable blade into the movable blade unit by, e.g., manually actuating the drive source in the movable blade unit. However, such a manual operation is usually complicated and time-consuming, and thus may delay the cutting process or a subsequent printing process.

SUMMARY OF THE INVENTION

It is an object of the present invention to provide a printer with a built-in type cutting section capable of facilitating a reduction in the size of a printer and capable of being readily repaired without requiring a specific manual operation when printing paper is jammed between a fixed blade and a movable blade during a paper cutting process.

It is another object of the present invention to provide a cutter capable of being incorporated in a printer, which has a built-in structure capable of facilitating a reduction in the overall size of the incorporated system and capable of being readily repaired without requiring a specific manual operation when printing paper is jammed between a fixed blade and a movable blade during a paper cutting process.

According to the present invention, there is provided a printer comprising a printing section for providing a print on printing paper fed continuously thereto; a cutting section arranged downstream of the printing section in a paper feeding direction, the cutting section including a fixed blade and a movable blade which cooperate with each other to cut the printing paper, the fixed blade and the movable blade being shiftable relative to each other between a cooperative mutually-adjoining position and an uncooperative mutually-remote position; a support mechanism for supporting the printing section and the cutting section, the support mechanism including a first support member supporting the fixed blade of the cutting section and a second support member supporting the movable blade of the cutting section, the first support member being fixedly arranged to specify an operative printing point in the printing section and the second support member being shiftably arranged relative to the first support member; and a drive source provided in the cutting section for generating a driving force to move the movable blade on the second support member, the drive source being mounted on the first support member.

The printer may further comprise a supplying section arranged upstream of the printing section in the paper feeding direction and receiving printing paper in a continuously feedable manner, wherein the first support member is associated with a stationary base carrying the printing paper received in the supplying section, and wherein the second support member is associated with a shiftable cover joined relatively shiftably with the stationary base and cooperating with the stationary base to define a paper receiving space in the supplying section.

In the printer, it is preferred that the cutting section be provided with a power transmission mechanism for transmitting the driving force of the drive source to the movable blade to move the movable blade, and that the power transmission mechanism include a first gear train disposed on the first support member and connected with the drive source and a second gear train disposed on the second support member and connected with the movable blade, the first gear train being connected with the second gear train when the fixed blade and the movable blade are in the mutually-adjoining position, the first gear train being disconnected from the second gear train as the fixed blade and the movable blade are shifted from the mutually-adjoining position to the mutually-remote position.

In this arrangement, it is advantageous that the cutting section also be provided with an elastic member for biasing the movable blade on the second support member toward a retraction position, and that the movable blade be operated for cutting by the driving force of the drive source against biasing force of the elastic member when the first gear train is connected with the second gear train, and be retracted into the retraction position under the biasing force of the elastic member when the first gear train is disconnected from the second gear train.

It is also advantageous that the second gear train include a pair of pinions rotatable synchronously with each other, the pinions being disposed alongside opposite lateral ends of the movable blade to transmit the driving force to the lateral ends.

The second gear train may include a pair of racks engagable respectively with the pair of pinions, the racks being secured to the lateral ends to cover local surface areas of the movable blade.

The printing section may be provided with a paper feed roller disposed on the second support member, a second drive source disposed on the first support member, independently from the drive source for the movable blade, for rotationally driving the paper feed roller on the second support member, and a second power transmission mechanism for transmitting driving force of the second drive source to the paper feed roller, and the second power transmission mechanism may includes a third gear train disposed on the first support member and connected with the second drive source and a fourth gear train disposed on the second support member and connected with the paper feed roller, the third gear train being constructed substantially identical to the first gear train.

Alternatively, the printing section may be provided with a paper feed roller disposed on the second support member, and the power transmission mechanism may be arranged to selectively transmit the driving force of the drive source to one of the movable blade and the paper feed roller to alternatively cause a cutting operation by the movable blade and a feeding operation by the paper feed roller.

It is additionally preferred that the cutting section be provided with a sensor for sensing the location of the movable blade in relation to the fixed blade in the mutually-adjoining position, and a controller for controlling the drive source in accordance with the sensing signal from the sensor.

The cutting section may be further provided with a pushing member for elastically pushing the fixed blade on the first support member in a direction such that the fixed blade is abutted to the movable blade.

The cutting section may also be provided with a movable blade guide for guiding the movable blade along a predetermined path during a cutting operation by the movable blade in the mutually-adjoining position.

In this arrangement, the movable blade guide may be disposed on the first support member, and the cutting section may be further provided with a release mechanism for forcibly displacing the movable blade guide from a guide position for engagement with the movable blade to a release position for release of the movable blade.

It is also advantageous that the fixed blade be located upstream of the movable blade in the paper feeding direction when the movable blade and the fixed blade are in the mutually-adjoining position.

The present invention also provides a cutter comprising a fixed blade and a movable blade, which cooperate with each other to cut printing paper, the fixed blade and the movable blade being shiftable relative to each other between a cooperative mutually-adjoining position and an uncooperative mutually-remote position; a first support member supporting the fixed blade and fixedly arranged in association with a supply source of the printing paper; a second support member supporting the movable blade and shiftably arranged relative to the first support member; and a drive source for generating driving force to move the movable blade on the second support member, the drive source being mounted on the first support member.

The cutter may be incorporated for use with a printer provided with a printing section, wherein the first support member is capable of being fixedly arranged to specify an operative printing point in the printing section.

In this cutter, the printer may also be provided with a supplying section arranged upstream of the printing section in a paper feeding direction, wherein the first support member is capable of being associated with a stationary base carrying the printing paper in the supplying section, and wherein the second support member is capable of being associated with a shiftable cover joined relatively shiftably with the stationary base and cooperating with the stationary base to define a paper receiving space in the supplying section.

The cutter may additionally comprise a power transmission mechanism for transmitting the driving force of the drive source to the movable blade to move the movable blade, wherein the power transmission mechanism includes a first gear train disposed on the first support member and connected with the drive source and a second gear train disposed on the second support member and connected with the movable blade, the first gear train being connected with the second gear train when the fixed blade and the movable blade are in the mutually-adjoining position, the first gear train being disconnected from the second gear train as the fixed blade and the movable blade are shifted from the mutually-adjoining position to the mutually-remote position.

In this arrangement, the cutter may also comprise an elastic member for biasing the movable blade on the second support member toward a retraction position, and the movable blade may be operated for cutting by the driving force of the drive source against biasing force of the elastic member when the first gear train is connected with the second gear train, and retracted to the retraction position due to the biasing force of the elastic member when the first gear train is disconnected from the second gear train.

BRIEF DESCRIPTION OF THE DRAWINGS

The above and other objects, features and advantages of the present invention will become more apparent from the following description of preferred embodiments in connection with the accompanying drawings, of which.

DESCRIPTION OF THE PREFERRED EMBODIMENT

Figure 1:
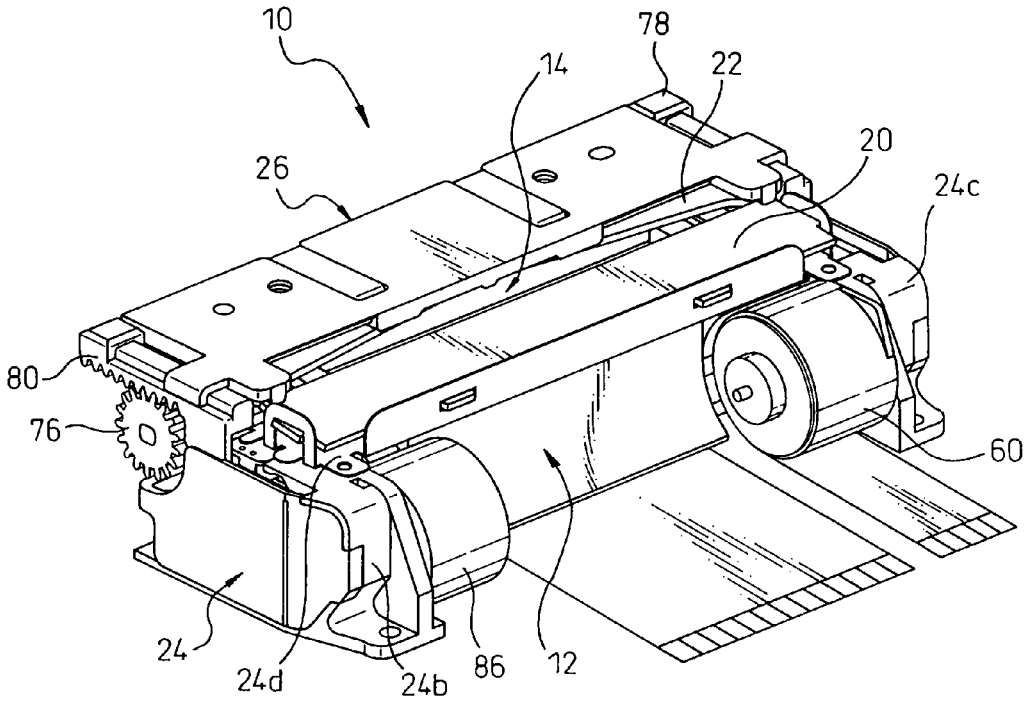
FIG. 1 is a perspective view showing a first embodiment of a printer according to the present invention.
Figure 2:
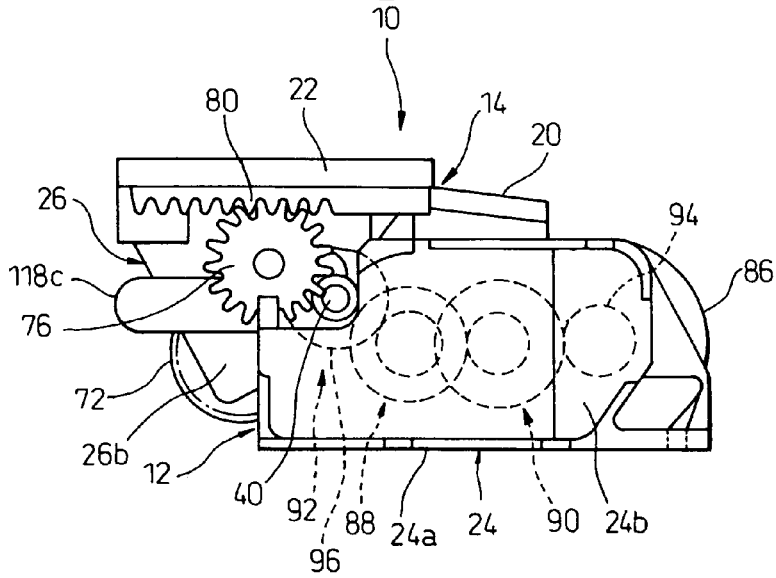
FIG. 2 is a side view schematically showing the printer of FIG. 1.
Figure 3:
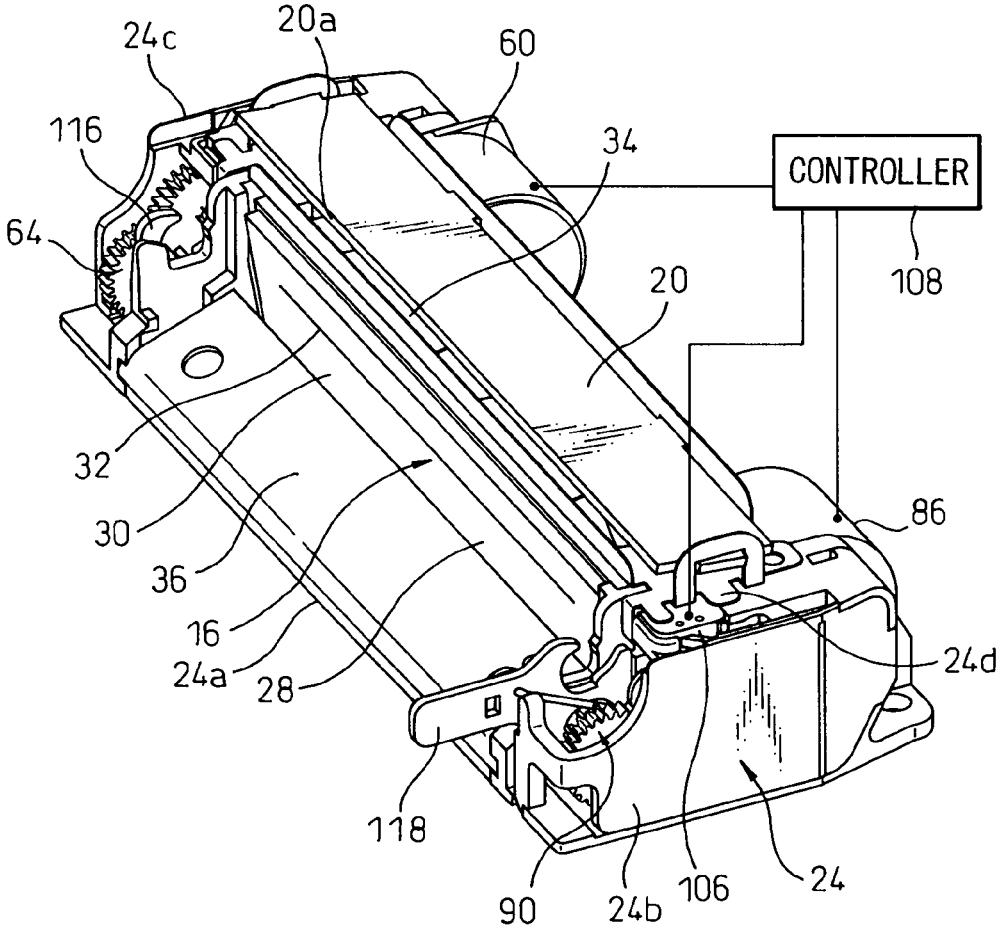
FIG. 3 is a perspective view showing components relating to a first support member in the printer of FIG. 1.
Figure 4:
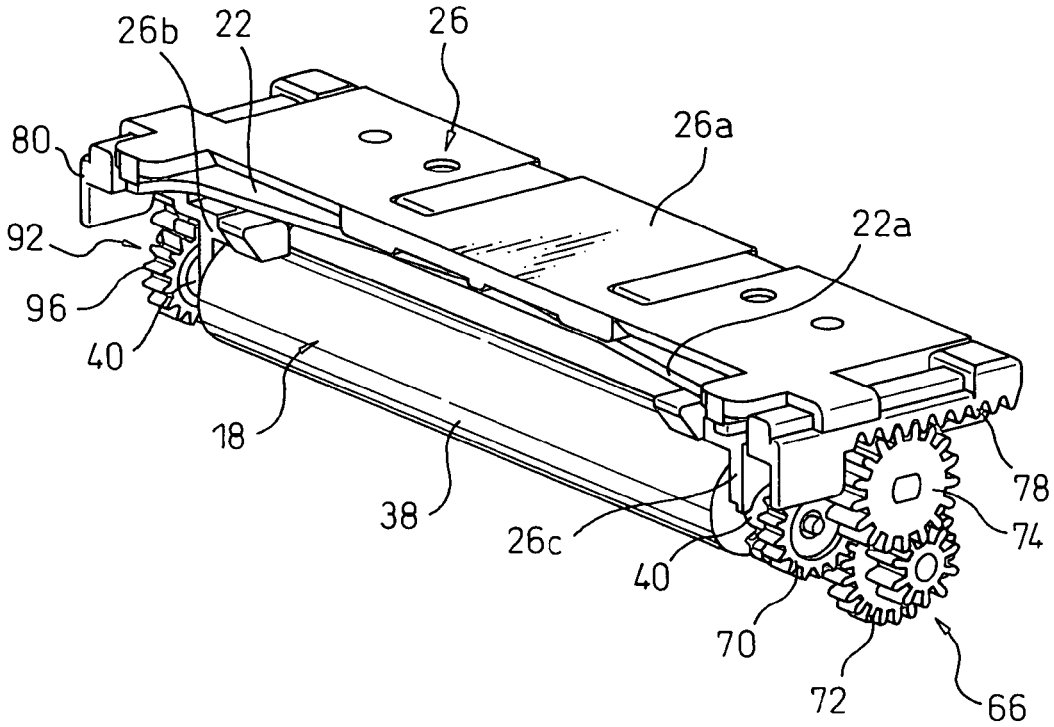
FIG. 4 is a perspective view showing components relating to a second support member in the printer of FIG. 1.

Referring now to the drawings, in which the same or similar components are denoted by common reference numerals, FIGS. 1 and 2 show a printer 10 according to the first embodiment of the present invention, and FIGS. 3 and 4 show the major components of the printer 10. The printer 10 of the illustrated embodiment has a construction of a thermal printer with a heat-sensitive printing section, which can be connected to a cash register, a portable terminal unit (e.g., an electronic notebook, a personal digital assistants (PDA), a mobile phone), and so on. However, the construction of the printing section in the printer according to the present invention is not limited thereto.

As shown in the drawings, the printer 10 is provided with a printing section 12 for printing on printing paper or a web fed continuously thereto, and a cutting section 14 arranged downstream of the printing section 12 in a paper feeding direction for automatically cutting the printing paper or web, after being subjected to a printing process, so as to cut off a printed length from an unprinted length (FIGS. 1 and 2). The printing section 12 includes a thermal head 16 (FIG. 3), a platen 18 (FIG. 4) cooperating with the thermal head 16 to nip the printing paper therebetween under an elastic biasing force, and a drive mechanism (as described later) rotationally driving the platen 18. The cutting section 14 includes a fixed blade 20 and a movable blade 22 (FIGS. 1 and 2), which cooperate with each other to cut the printing paper, and a drive mechanism (as described later) for driving the movable blade to perform a cutting operation.

The printer 10 is also provided with a support mechanism for supporting the printing section 12 and the cutting section 14. The support mechanism includes a first support member 24 supporting the thermal head 16 of the printing section 12 and the fixed blade 20 of the cutting section 14, and a second support member 26 supporting the platen 18 of the printing section 12 and the movable blade 22 of the cutting section 14 (FIGS. 1 and 2). The fixed blade 20 is disposed on the first support member 24 in close proximity to the thermal head 16 and downstream of the thermal head 16 as seen in the paper feeding direction. The movable blade 22 is disposed on the second support member 26 in close proximity to the platen 18 and downstream of the platen 18 as seen in the paper feeding direction.

The first support member 24 includes a bottom frame part 24*a* having a generally rectangular shape, a pair of side frame parts 24*b*, 24*c* formed upright along longitudinally opposing ends of the bottom frame part 24*a*, a top frame part 24*d* spaced from and oppositely facing the bottom frame part 24*a* so as to extend between the side frame parts 24*b*, 24*c* (FIG. 3). The second support member 26 includes a top frame part 26*a* having a generally rectangular shape, a pair of side frame parts 26*b*, 26*c* formed upright along longitudinally opposing ends of the base frame part 26*a* (FIG. 4).

The first and second support members 24, 26 are structurally independent from each other. As a result, the printer 10 is constructed such that the printing section 12 and the cutting section 14 have an openable/closable structure which enables the thermal head 16 and the platen 18 to shift relative to each other between a closed position, wherein the head and the platen mutually contact under pressure during a printing process, and an open position, wherein the head and the platen are sufficiently spaced from each other during paper setting, and which also enables, simultaneously with the above-described open/close motion, the fixed blade 20 and the movable blade 22 to shift relative to each other between a mutually-adjoining position wherein the blades are cooperative during a paper cutting process and a mutually-remote position wherein the blades are uncooperative during the paper setting.

The thermal head 16 of the printing section 12 includes a flat plate-shaped substrate 28 having a generally flat printing face 30, the substrate 28 being preferably made of a hard material such as ceramic, and a heat generating element 32 arranged at a desired position on the printing face 30 of the substrate 28. The thermal head 16 may have a line-dot structure wherein the heat generating element 32 is made by placing a large number of dot-shaped heat generators in a linear array on the printing face 30 of the substrate 28 and a printing operation is performed by electrically scanning the heat generators. The thermal head 16 is placed on the bottom frame part 24*a* of the first support member 24 between the side frame parts 24*b*, 24*c* in an upright standing position with the printing face 30 being exposed, and is supported in an elastically displaceable manner over a predetermined to-and-fro distance through an elastic member 34 such as a leaf spring. The printing section 12 further includes, adjacent to the first support member 24, a control circuit board (not shown) electrically connected to both the thermal head 16 and a platen drive mechanism (as described later), and a paper guide 36 disposed near the thermal head 16 above the bottom frame part 24*a*.

The platen 18 includes a cylindrical body 38, preferably made of an elastic material such as rubber, and a shaft 40 fixed to the body 38 along its center axis, the shaft 40 projecting in an axial direction from the axial opposite end faces of the body 38. The platen 18 is rotatably supported between the side frame parts 26*b*, 26*c* of the second support member 26 beneath the top frame part 26*a* through the shaft 40 having a bearing unit (not shown). The first and second support members 24, 26 are arranged in a predetermined positional correlation such that, during a printing process, the printing face 30 of the thermal head 16 faces substantially parallel to the outer circumferential surface of the body 38 of the platen 18, and that the printing face 30 of the thermal head 16 is pressed against the body 38 of the platen 18 by the elastic biasing force of the elastic member 34 provided in the first support member 24. In this arrangement, the heat generating element 32 of the thermal head 16 constitutes a substantially stationary, operative printing point, under pressure applied from the platen 18.

The platen 18 is rotationally driven by the drive mechanism as described later, to continuously forward the printing paper or web fed into the printing section 12 while nipping the printing paper between the thermal head 16 and the platen 18 under pressing force. During this period, the thermal head 16 executes a desired printing operation onto the printing paper, with the heat generating element 32 provided on the printing face 30 electrically operating. In this way, the platen 18 functions as a back-up roller to realize a stable printing operation on the printing paper by the thermal head 16, and also functions as a paper feed roller to continuously forward the printing paper by frictional force.

The fixed blade 20 of the cutting section 14, which is a generally rectangular plate-like member made of a hard material such as a metal, is disposed on the top frame part 24*d* of the first support member 24 in a flat posture with a straight cutting edge 20*a* being oriented toward the thermal head 16. The fixed blade 20 is supported above the first support member 24 in an elastically displaceable manner over a predetermined distance through an elastic pushing member (as described later) such as a leaf spring. The movable blade 22 of the cutting section 14, which is a shaped plate-like member made of a hard material such as a metal, is disposed on the top frame part 26*a* of the second support member 26 in a flat posture with a V-shaped cutting edge 22*a* being oriented toward the platen 18. The movable blade 22 is supported on guiding shoulders 26*d* (see FIG. 7) formed respectively in the side frame parts 26*b*, 26*c* of the second support member 26 in a slidable manner. The fixed blade 20 and the movable blade 22 coact to cut the printing paper, by a cooperative shearing function of the straight edge 20*a* and the V-shaped edge 22*a*, in a direction perpendicular to the paper feeding direction and gradually proceeding from the lateral peripheral ends of the printing paper toward the center axis of the latter.

The cutting section 14 is constituted such that the fixed blade 20 is located upstream of the movable blade 22 in the paper feeding direction in closer proximity to the printing section 12 than the movable blade 22 (i.e., disposed at the inner side of the movable blade 22) when the fixed and movable blades 20, 22 are in the mutually-adjoining position, wherein the blades 20, 22 are cooperative during a cutting process. According to this blade arrangement, the unprinted length of the printing paper after being cut by the cutting section 14 can stand by for a subsequent printing process in a condition where the leading end of the cut unprinted length is placed adjacent to the cutting edge of the fixed blade 20. Consequently, it is possible to avoid interference between the leading end of the printing paper and the fixed blade 20 upon starting the subsequent printing process, and thus for the printing process to proceed smoothly.

Figure 5:
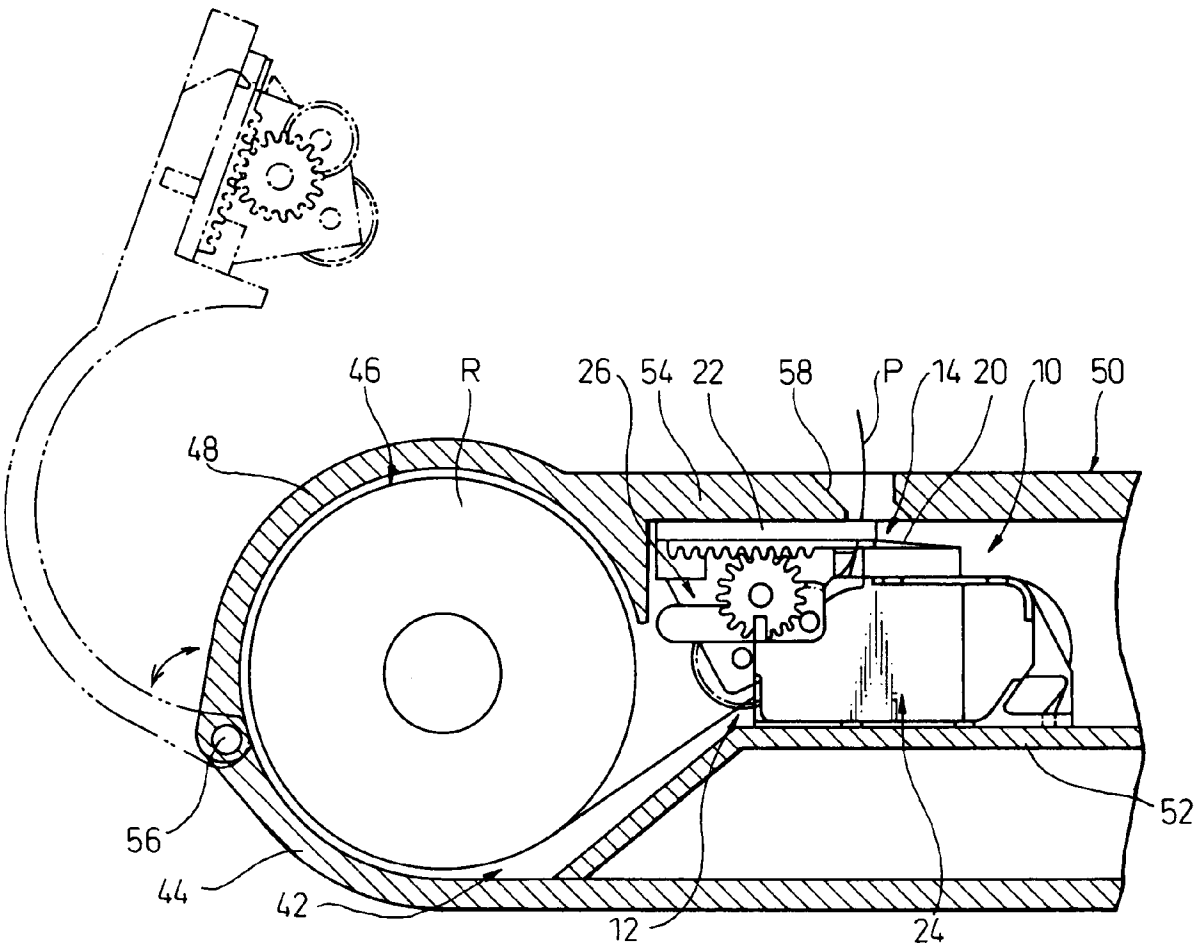
FIG. 5 is a sectional view schematically showing one operation mode of the printer of FIG. 1.
Figure 6A:
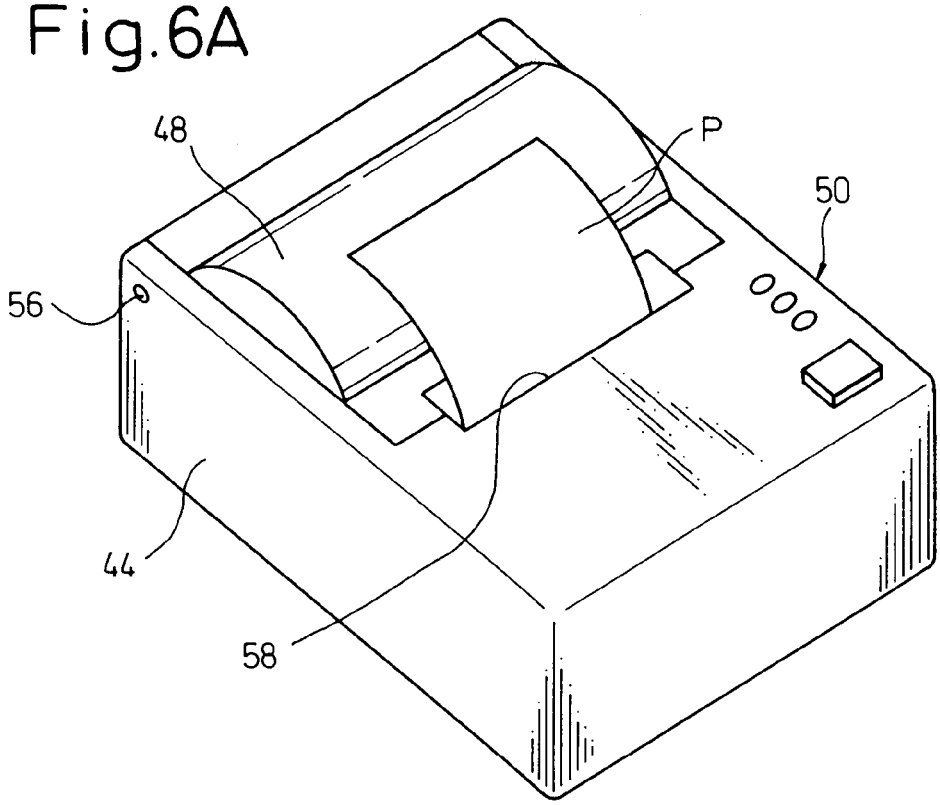
FIG. 6A shows the printer in the operation mode of FIG. 5, with a cover closed.
Figure 6B:
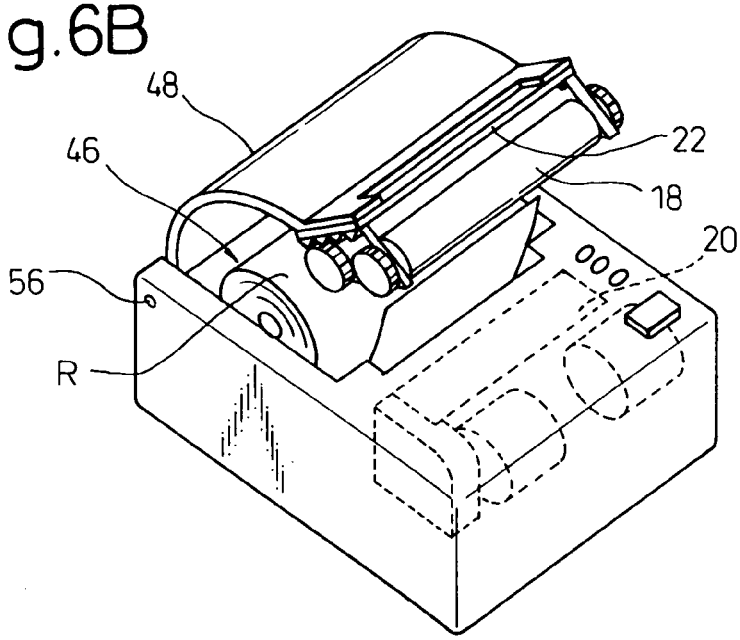
FIG. 6B shows the printer in the operation mode of FIG. 5, with a cover opened.

As the characteristic features of the printer 10, the printing section 12 and the cutting section 14, having the openable/closable structure as described above, is configured such that the first support member 24 is fixedly arranged to specify and locate the operative printing point (i.e., the point or position of the heat generating element 32 of the thermal head 16) in the printing section 12, and that the second support member 26 is shiftably arranged relative to the first support member 24. This configuration is described in more detail below, while referring to one useful mode of the printer 10 as shown in FIGS. 5, 6A and 6B.

The printer 10 may further include, in one useful mode, a supplying section 42 (or a paper supplying source) arranged upstream of the printing section 12 in the paper feeding direction and receiving printing paper P in a continuously feedable manner. In this arrangement, it is advantageous that the printer 10 be provided with a casing 50 having a clamshell structure, which includes a stationary base 44 carrying the rolled printing paper or web P (i.e., a roll paper R) received in the supplying section 42 and a shiftable cover 48 joined relatively shiftably with the stationary base 44 and cooperating with the stationary base 44 to define a paper receiving space 46 in the supplying section 42. The casing 50 includes a first mount 52 integrally joined to the stationary base 44, and the first support member 26 of the printer 10 is fixedly mounted on the first mount 52. The casing 50 further includes a second mount 54 integrally joined to the shiftable cover 48, and the second support member 26 of the printer 10 is mounted on the second mount 54. The shiftable cover 48 is pivotably joined at one end thereof, away from the second mount 54, to one end of the stationary base 44, away from the first mount 52, through a pivot shaft 56.

The above configuration of the printer 10 may be illustratively explained in accordance with the useful mode thereof as follows. Specifically, the first support member 24 is fixedly disposed to be associated with the stationary base 44 carrying the printing paper P (or the roll paper R) received in the supplying section 42 and thereby specifies the operative printing point (or the point or position of the heat generating element 32 of the thermal head 16) in the printing section 12 at a predetermined position in the casing 50. Also, the second support member 26 is associated with the shiftable cover 48 joined relatively rotatably with the stationary base 44 to define the paper receiving space 46 of the supplying section 42 and is shiftably disposed in a pivoted manner in relation to the operative printing point of the printing section 12 specified on the first support member 24. In this connection, it should be noted that the first support member 24 and the second support member 26 may be fully integrated with the casing 50 as a unitary structure so as to respectively include the stationary base 44 and the shiftable cover 48.

When the shiftable cover 48 of the casing 50 is shut on the stationary base 44, the thermal head 16 and the platen 18 in the printing section 12 are kept in the aforementioned closed position, and the fixed blade 20 and the movable blade 22 in the cutting section 14 are kept in the aforementioned mutually-adjoining position. In this state, a distal end of the second mount 54, located at the free end of the shiftable cover 48, cooperates with a distal end of the remainder of the casing 50, associated with the stationary base 44, to define therebetween a paper outlet 58, through which printing paper P passing through the printing section 12 and the cutting section 14 of the printer 10 is directed outward. When the shiftable cover 48 of the casing 50 is fully opened on the stationary base 44, the thermal head 16 and the platen 18 in the printing section 12 are kept in the aforementioned open position, and the fixed blade 20 and the movable blade 22 in the cutting section 14 are kept in the aforementioned mutually-remote position.

The constructions of drive mechanisms for the printing section 12 and the cutting section 14 are described below.

Figure 7:
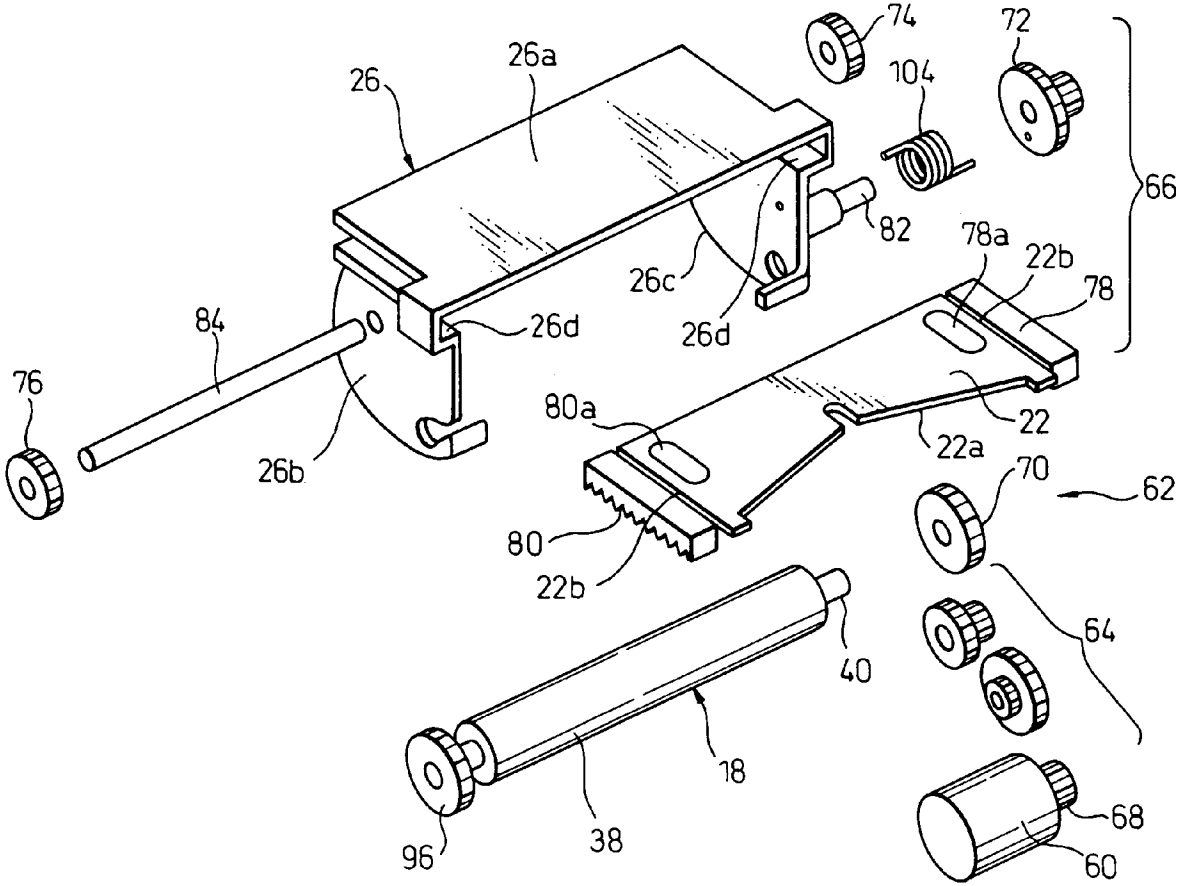
FIG. 7 is an exploded perspective view showing a cutting section drive mechanism in the printer of FIG. 1.

As shown in FIG. 7, a drive mechanism for the cutting section 14 is provided with a first or movable blade drive source 60 for generating driving force to move the movable blade 22 relative to the second support member 26 and a power transmission mechanism 62 for transmitting the driving force of the movable blade drive source 60 to the movable blade 22 to move the movable blade 22. The movable blade drive source 60, which is structured as, e.g., a pulse motor, is mounted securely on the first support member 24 and disposed behind the thermal head 16 (FIG. 1). The power transmission mechanism 62 includes a first gear train 64 disposed on the first support member 24 and connected with the movable blade drive source 60 and a second gear train 66 disposed on the second support member 26 and connected with the movable blade 22. The first gear train 64 and the second gear train 66 are connected with each other when the fixed blade 20 and the movable blade 22 are in the mutually-adjoining position, and are disconnected from each other as the fixed blade 20 and the movable blade 22 are shifted from the mutually-adjoining position to the mutually-remote position.

The first gear train 64 of the power transmission mechanism 62 includes a plurality of gears involving a driving gear 68 fixed to the output shaft of the movable blade drive source 60, and is disposed alongside one side frame part 24*c* of the first support member 24 to transmit the output torque of the movable blade drive source 60 in a suitable reduction ratio. The second gear train 66 includes a plurality of gears involving an idler gear 70 rotatably carried on the shaft 40 of the platen 18, and is disposed alongside opposite side frame parts 26*b*, 26*c* of the second support member 26 to transmit the torque, transmitted from the first gear train 64, to the movable blade 22.

More specifically, the second gear train 66 includes the idler gear 70, an intermediate gear 72 engagable with the idler gear 70, a first pinion 74 engagable with the intermediate gear 72, a second pinion 76 rotatable synchronously with the first pinion 74, and first and second racks 78, 80 respectively engagable with the first and second pinions 74, 76. The idler gear 70 is rotatably carried on the platen shaft 40 supported on one side frame part 26*c* of the second support member 26, corresponding to one side frame part 24*c* of the first support member 24 along which the first gear train 64 is disposed. The intermediate gear 72 is carried on a spindle 82 formed upright at a predetermined position on the outer face of the side frame part 26*c* of the second support member 26. In this connection, it should be noted that the idler gear 70 may be rotatably attached to another shaft formed on the side frame part 24*c*.

The first pinion 74 and the second pinion 76 are respectively secured to the opposite ends of a link shaft 84 supported on and extending between the side frame parts 26*b*, 26*c* of the second support member 26, and are disposed alongside the opposite lateral ends 22*b* of the movable blade 22 and outside of the side frame part 26*c* and the side frame part 26*b*, respectively. The first rack 78 and the second rack 80, acting as driven gears, include attachment pieces 78*a*, 80*a* integrally formed therewith, respectively, and are secured to the lateral ends 22*b* of the movable blade 22 via the attachment pieces 78*a*, 80*a*, respectively. According to this arrangement, the driving force (or torque) of the movable blade driving source 60 is transmitted, through the first and second gear trains 64, 66, substantially equally to the lateral ends 22*b* of the movable blade 22. As a result, the movable blade 22 can be smoothly translated or slid along the guiding shoulders 26*d* of the second support member 26 without being caught thereon due to the tilting of the blade 22. In this connection, it should be noted that the above-described lateral-ends driving feature of the movable blade 22 (especially, the second pinion 76, the second rack 80 and the link shaft 84) may be omitted by improving the slidable guiding function for the movable blade 22 on the second support member 26.

As shown in FIGS. 2 and 3, a drive mechanism for the printing section 12 is provided with the platen 18 acting as a paper feed roller, a second or roller drive source 86 for generating driving force to rotate the platen 18 on the second support member 26, and a second power transmission mechanism 88 for transmitting the driving force of the roller drive source 86 to the platen 18 in order to rotate the platen 18. The roller drive source 86, which is structured as, e.g., a pulse motor, is mounted securely on the first support member 24 and disposed behind the thermal head 16 to be opposed to the movable blade drive source 60 (FIG. 1). The second power transmission mechanism 88 includes a third gear train 90 disposed on the first support member 24 and connected with the roller drive source 86 and a fourth gear train 92 disposed on the second support member 26 and connected with the platen 18. The third gear train 90 and the fourth gear train 92 are connected with each other when the thermal head 16 and the platen 18 are in the closed position in a mutually pushed condition, and are disconnected from each other as the thermal head 16 and the platen 18 are shifted from the closed position to the open position.

The third gear train 90 of the power transmission mechanism 88 includes a plurality of gears containing a driving gear 94 fixed to the output shaft of the roller drive source 86, and is disposed alongside the side frame part 24*b* of the first support member 24 to transmit the output torque of the roller drive source 86 in a suitable reduction ratio. The fourth gear train 92 includes a driven gear 96 secured to the shaft 40 of the platen 18, and is disposed alongside the side frame part 26*b* of the second support member 26 to transmit the torque, transmitted from the third gear train 90, to the platen 18. According to this arrangement, the driving force (or torque) of the roller drive source 86 is transmitted to the platen 18 through the third and fourth gear trains 90, 92.

According to the printer 10 having the above-described configuration, the thermal head 16 and the platen 18 of the printing section 12 as well as the fixed blade 20 and the movable blade 22 of the cutting section 14 are respectively incorporated in the first and second support members 24, 26 as mutually independent members constituting an openable/closable support structure, so that the cutting section 14 is structurally integrated with the printing section 12, and that the overall size of the printer 10 with automatic cutter is significantly reduced in comparison with a conventional printer provided with a movable blade unit as a self-contained apparatus. In particular, the illustrated configuration, in which the cutting section drive mechanism, having a constitution similar to that of the printing section drive mechanism, is disposed on the first and second support members 24, 26 opposite to the printing section drive mechanism, contributes to the simplification of the construction and reduction of the number of components, and further facilitates reduction in the size of the printer 10.

Also, in the above-described openable/closable support structure, the conventional arrangement of the cutting section is adopted, wherein the fixed blade 20 is disposed inside of the movable blade 22 in the mutually-adjoining position thereof, while the first support member 24 supporting the fixed blade 20 is formed as a stationary member and the second support member 26 supporting the movable blade 22 is formed as a shiftable member, so that it is possible to readily shift the second support member 26 relative to the first support member 24 with no obstacle, in the case where printing paper is unintentionally jammed between the fixed blade 20 and the movable blade 22 during the paper cutting process, causing malfunctioning of the movable blade 22. In particular, even in the case where the clamshell structure is adopted, it is possible to readily pivotally shift the shiftable cover 48 associated with the second support member 26 in relation to the stationary base 44 associated with the first support member 24, so as to quickly separate the movable blade 22 from the fixed blade 20. Therefore, in the printer 10, when printing paper is jammed between the fixed blade 20 and the movable blade 22 during the cutting process, it is possible to quickly eliminate paper jamming without the need for a specific manual operation, merely by shifting the second support member 26 relative to the first support member 24, and thus to restore the paper cutting function of the cutting section 14 while minimizing the delay in the cutting process or a subsequent printing process.

Further, in the printer 10, the movable blade drive source 60 of the cutting section 14 is disposed on the first support member 24, so that in the case where the clamshell-type support structure is adopted, it is possible to prevent the weight of the shiftable cover 48 associated with the second support member 26 from increasing, and thus to lightly actuate the shiftable cover 48. Also, it is not necessary to lay on the shiftable cover 48 the wiring of the movable blade drive source 60 for the purpose of electric supply and control, which simplifies the entire wiring structure in the printer 10.

The above-described configuration of the cutting section 14 of the printer 10 may also be considered as a paper cutter capable of being incorporated in a printer, which includes the fixed blade 20 and the movable blade 22, shiftable relative to each other between the mutually-adjoining position and the mutually-remote position, the first support member 24 as a fixedly arranged member for supporting the fixed blade 20, and the second support member 26 as a shiftably arranged member for supporting the movable blade 22. This cutter has a built-in structure capable of facilitating reduction of the overall size of the printer system into which the cutter is incorporated, and able to be readily repaired without requiring a specific manual operation when printing paper is jammed between the fixed blade 20 and the movable blade 22 during a paper cutting process. Also, in this cutter, the movable blade drive source 60 for generating the driving force to move the movable blade 22 on the second support member 26 is disposed on the first support member 24, so that, in the case where the clamshell-type support structure is adopted, it is possible to prevent an increase in the weight of the shiftable cover 48, and to simplify the entire wiring structure in the printer system.

The printer 10 having the aforementioned constitution may be additionally or alternatively provided with various characteristic features possessing the following advantageous effects.

Figure 8A:
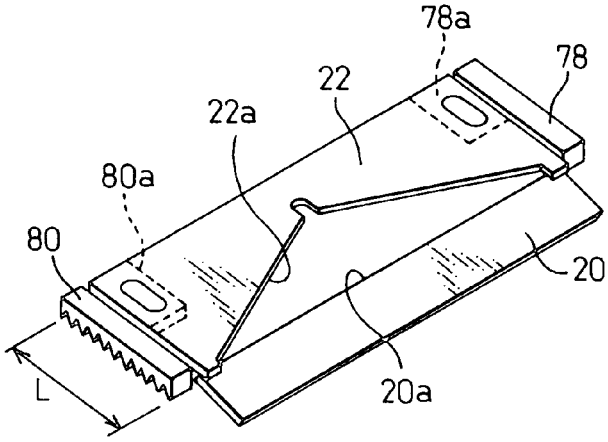
FIGS. 8A and 8B schematically show fixed and movable blades of a cutting section in the printer of FIG. 1.
Figure 8B:
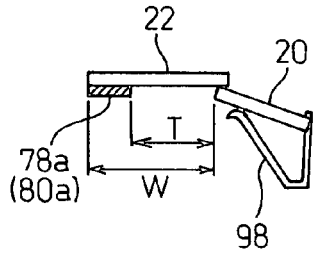

As shown in FIGS. 8A and 8B, the first and second racks 78, 80 may be respectively disposed outside of the lateral ends 22*b* of the movable blade 22 by fixing the attachment pieces 78*a*, 80*a* thereof to the movable blade 22. In this arrangement, in the case where each attachment piece 78*a*, 80*a* is miniaturized within a necessary limit and is located so as to avoid interference with the fixed blade 20 during a cutting operation by the movable blade 22, the length L (FIG. 8A) of each rack 78, 80, which serves to ensure the maximum travel T (FIG. 8B) of the movable blade 22 for the cutting operation, can be brought close to the depth W (FIG. 8B) of the movable blade 22. In other words, it is possible to reduce the depth W of the movable blade 22 within a necessary limit, in the case where the racks 78, 80 having predetermined length L are used.

Figure 9:
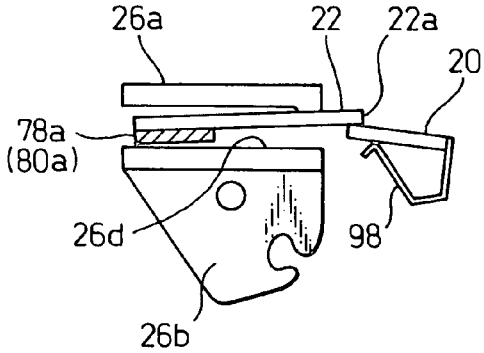
FIG. 9 is a side view schematically showing the fixed and movable blades of FIG. 8A in an operative state.

Also, in this arrangement, it is advantageous to form the attachment pieces 78*a*, 80*a* of the first and second racks 78, 80 so as to cover local surface areas (in a lower surface, in the drawing) of the movable blade 22. In this connection, the fixed blade 20 is provided in association with a pushing member 98 (FIG. 8B) for elastically pushing or biasing the fixed blade 20 on the first support member 24 in a direction for abutting the fixed blade 20 to the movable blade 22, as already described. Therefore, when the movable blade 22 moves for cutting on the second support member 26, the movable blade 22 is pushed and raised slightly by the fixed blade 20 in a region including the cutting edge 22*a* as shown in FIG. 9, and thereby the rear end of the movable blade 22, away from the cutting edge 22*a*, is urged against the guiding shoulder 26*d* of the second support member 26, which may impede the smooth motion of the movable blade 22. Thus, the attachment pieces 78*a*, 80*a* of the racks 78, 80 are advantageously arranged to be located between the lower surface of the movable blade 22 and the guiding shoulders 26*d* of the second support member 26, so that the movable blade 22 is able to move smoothly. From this viewpoint, it is preferred that the racks 78, 80 or at least the attachment pieces 78*a*, 80*a* be made from resinous materials having self-lubricating properties.

It should be noted that the pushing member 98 for biasing the fixed blade 20 is an indispensable component for improving the cutting function of the fixed blade 20 in cooperation with the movable blade 22. Therefore, it is advantageous to integrate the pushing member 98 with the elastic member 34 for elastically supporting the thermal head 16, so as to reduce the number of components. Also, in place of the pushing member 98, another pushing member for pushing the movable blade 22 toward the fixed blade 20 may be used.

Figure 10A:
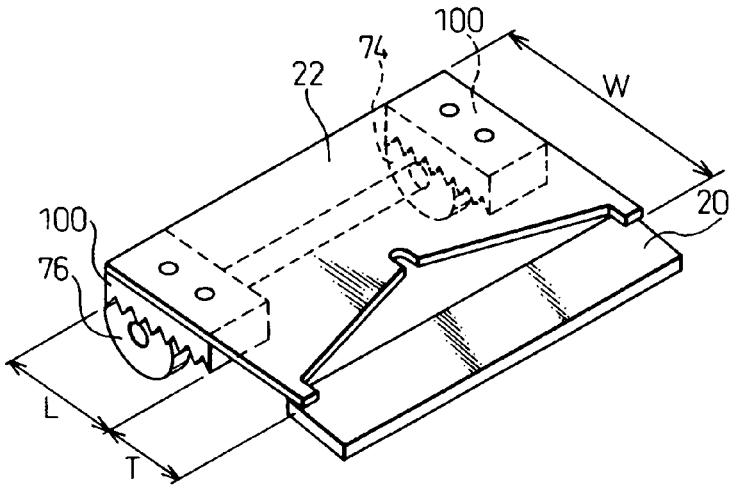
FIGS. 10A and 10B schematically show one modification of a movable blade and a drive mechanism thereof.
Figure 10B:
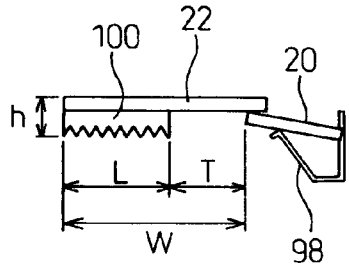

As shown in FIGS. 10A and 10B, a pair of racks 100 disposed on the lower surface of the movable blade 22 may be used in place of the first and second racks 78, 80. In this arrangement, the racks 100 and the corresponding pinions 74, 76 do not project laterally outward from the movable blade 22, which is advantageous in the case where the lateral dimension of the printer 10 (as seen in a direction transverse to the printing paper) is restricted. On the other hand, while the length L of each rack 100 is determined so as to ensure the maximum travel T of the movable blade 22 for the cutting operation, the depth W of the movable blade 22 becomes at least the total value of the length L and the travel T, which may enlarge the longitudinal dimension of the printer 10. In this case, the height "h" of the movable blade 22 including the rack 100 also becomes larger in comparison with the arrangement shown in FIGS. 8A and 8B.

Figure 11A:
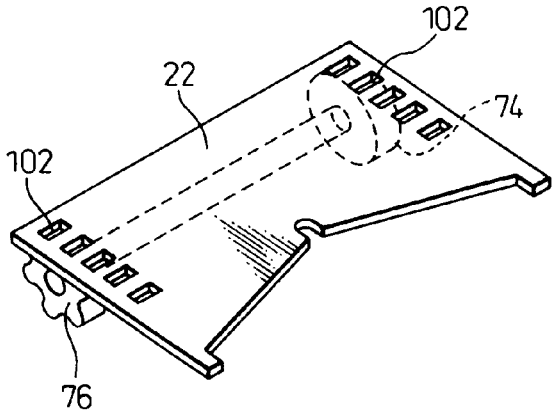
FIGS. 11A and 11B schematically show another modification of a movable blade and a drive mechanism thereof.
Figure 11B:
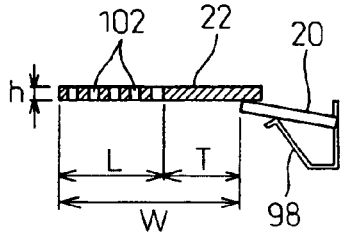

As shown in FIGS. 11A and 11B, no rack may be used, and the movable blade 22 may be provided with a plurality of apertures 102 directly formed therethrough, with which the pinions 74, 76 are respectively engaged. In this arrangement, although the depth W of the movable blade 22 is similar to that in the arrangement shown in FIGS. 10A and 10B, it is possible to reduce the height "h" of the movable blade 22 in comparison with the arrangement of FIGS. 10A and 10B.

Figure 12:
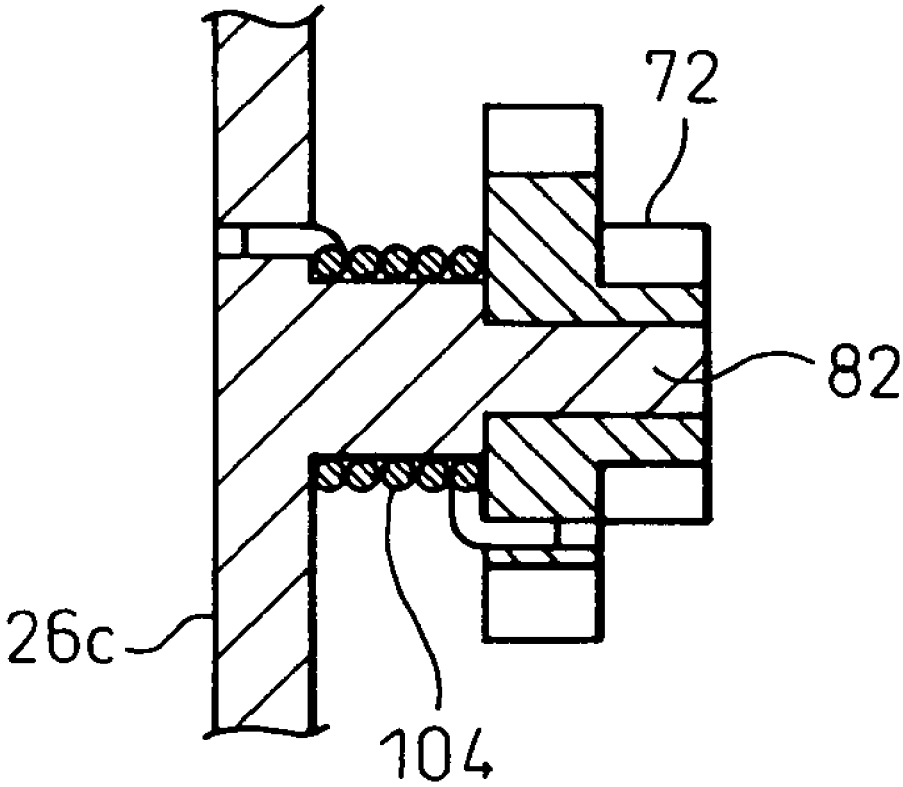
FIG. 12 is a sectional view showing a return spring in a movable blade drive mechanism.

In the printer 10, it is important and desirable from the viewpoint of operator safety that when the first and second support members 24, 26 are opened, or when the fixed and movable blades 20, 22 of the cutting section 14 are shifted from the mutually-adjoining position to the mutually-remote position for resolving the paper jamming condition, the movable blade 22 not be freely movable on the second support member 26. To this end, as shown in FIGS. 7 and 12, the cutting section 14 may be provided with an elastic member 104 for elastically biasing the movable blade 22 on the second support member 26 toward a retraction position where the cutting edge 22*a* is retracted inside the second support member 26. The elastic member 104 may be constructed as a return spring such as a torsion coil spring 104 as illustrated. In this case, the torsion coil spring 104 is disposed around the spindle 82 formed upright on the side frame part 26*c* of the second support member 26, and is fixedly connected at one end to the side frame part 26*c* and at the other end to the intermediate gear 72. The elastic member 104 such as the torsion coil spring 104 continuously acts to elastically bias the intermediate gear 72 in a rotational direction for moving the movable blade toward the retraction position where the cutting edge 22*a* is hidden under the top frame part 26*a* of the second support member 26.

According to the above arrangement, the movable blade 22 performs a normal cutting motion by means of the driving force of the movable blade drive source 60 against the biasing force of the elastic member 104, during the period when the movable blade 22 and the fixed blade 20 are in the mutually-adjoining position and when the first and second gear trains 64, 66 of the power transmission mechanism 62 are connected with each other. In this state, the movable blade 22 also performs a normal return motion by means of the driving force of the movable blade drive source 60 in a reverse mode, acting in the same direction as the biasing force of the elastic member 104. On the other hand, at the time the movable blade 22 is moved from the mutually-adjoining position to the mutually-remote position in order to eliminate a paper jam occurring during a paper cutting process, the second gear train 66 is disconnected from the first gear train 64, and at this instant, the movable blade 22 is automatically retracted into the retraction position by the biasing force of the elastic member 104. During the period when the first and second support members 24, 26 are opened, the movable blade 22 is continuously held at the retraction position under the biasing force of the elastic member 104.

In the case of the printer 10, it is necessary to correctly locate the movable blade 22 at the above-described retraction position or a predetermined initial position near the retraction position before the printing process is started, for the purpose of improving the reliability of the paper cutting operation by the cutting section 14. To this end, as shown in FIG. 3, the cutting section 14 may be further provided with a sensor 106 for sensing the location of the movable blade 22 in relation to the fixed blade 20 in the mutually-adjoining position, and a controller 108 for controlling the movable blade drive source 60 in accordance with the sensing signal of the sensor 106. The sensor 106, which may be constituted by a mechanical, optical or magnetic sensor, is fixedly disposed on the first support member 24 at a predetermined position near the fixed blade 20, so as to sense the motion of the movable blade 22 starting from the retraction or initial position. The controller 108 may be formed from a component common to a drive controller (not shown) for the thermal head 16 and the platen 18 in the printing section 12. According to this arrangement, it is possible to prevent the increase of the number of parts, and in the case where the clamshell structure is adopted, it is not necessary to lay on the shiftable cover 48 the wiring of the sensor 106, which simplifies the entire wiring structure in the printer 10.

Figure 13:
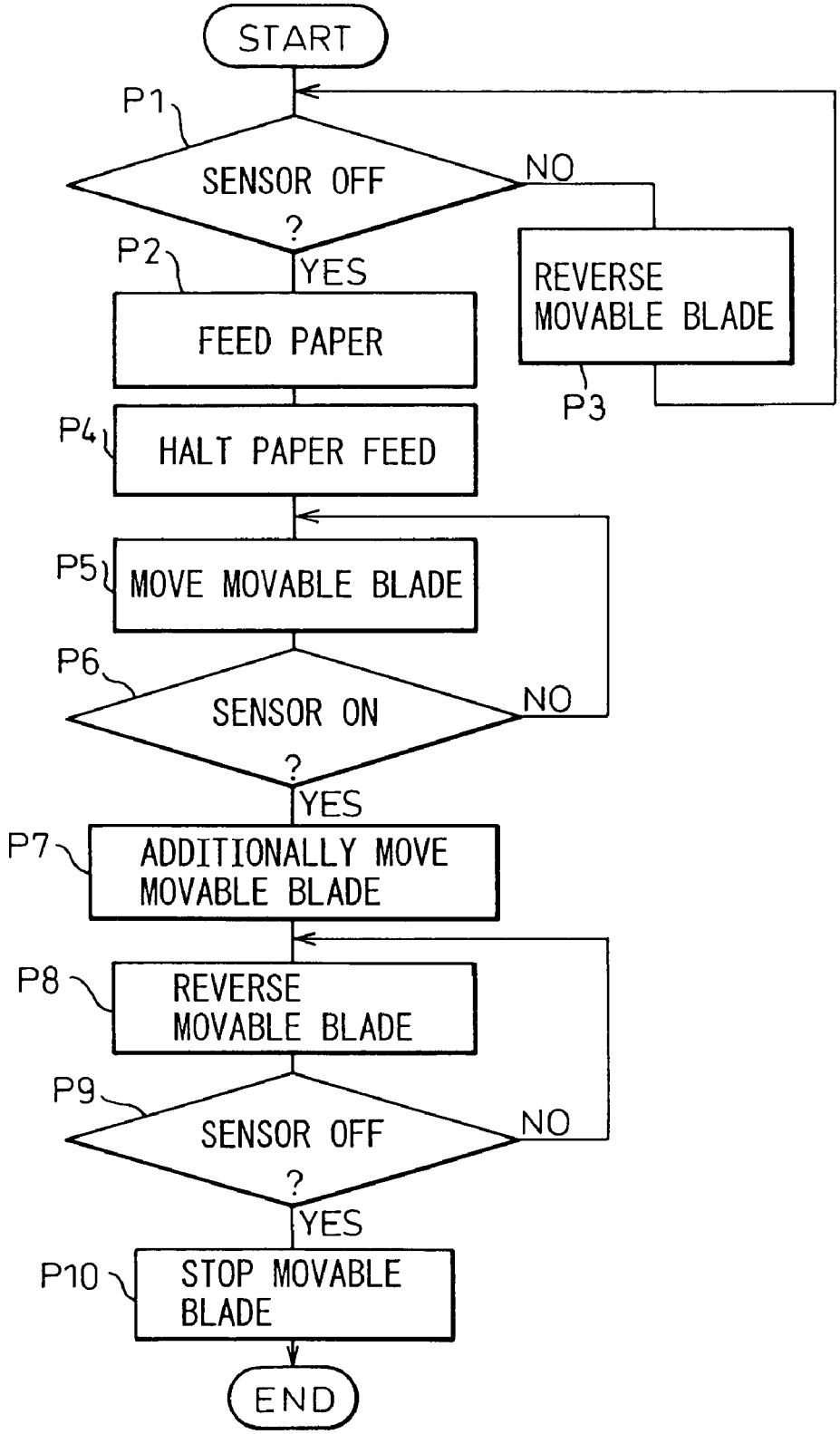
FIG. 13 is a flow chart showing an example of operation control for a platen and a movable blade performed by a controller.

The exemplary embodiment of operational control for the printing section 12 and the cutting section 14 by the controller 108, formed from a component common to a drive controller for the printing section 12, is described below with reference to FIG. 13.

Upon starting a printing process, it is first judged, in step P1, whether the sensor 106 is in an off-state (wherein motion of the movable blade 22 is not sensed). When the sensor 106 is judged as being in the off-state, the roller drive source 86 is energized in a normal direction, in step P2, to drive the platen 18 for normal rotation so as to feed printing paper or a web in a regular direction. On the other hand, if the sensor 106 is judged as being in an on-state (wherein motion of the movable blade 22 is sensed), the movable blade drive source 60 is energized in a reverse direction, in step P3, to move the movable blade 22 until the sensor 106 is turned to the off-state (i.e., until the movable blade 22 reaches the retraction or initial position). Then, the printing section 12 performs the printing process while the printing paper is fed in the regular direction, and after the printing process is completed, the roller drive source 86 is de-energized, in step P4, to halt feeding of printing paper.

Next, in step P5, the movable blade drive source 60 is energized in a normal direction to move the movable blade 22 from the retraction or initial position in a paper cutting direction, so as to turn the sensor 106 to the on-state. If it is judged, in step P6, that the sensor 106 is in the on-state, the movable blade drive source 60 is operated in a normal direction for a predetermined supplementary value based on, e.g., a pulse number, in step P7, to additionally move the movable blade 22 in the paper cutting direction so as to cut the printing paper. In this connection, it is possible to select either one of two modes, such that in one mode the printing paper is completely cut and in the other mode is partially cut (in the latter case, a cut-free area remains in the printing paper), by setting the supplementary value or pulse number as desired. If the sensor 106 is judged, in step P6, as still being in the off-state, the control flow is returned to step P5.

After the movable blade 22 is moved for the predetermined supplementary value, the movable blade drive source 60 is energized in the reverse direction, in step P8, to move the movable blade 22 until the sensor 106 is turned to the off-state (i.e., until the movable blade 22 reaches the retraction or initial position). If it is judged, in step P9, that the sensor 106 is in the off-state, the movable blade drive source 60 is de-energized, in step P10, to stop the movable blade 22. If the sensor 106 is judged, in step P9, as still being in the on-state, the control flow is returned to step P8.

According to the above-described operational control, it is ensured that the movable blade 22 is placed at the retraction or initial position before a printing process is started, thereby improving the reliability of the paper cutting operation in the cutting section 14.

Figure 14:
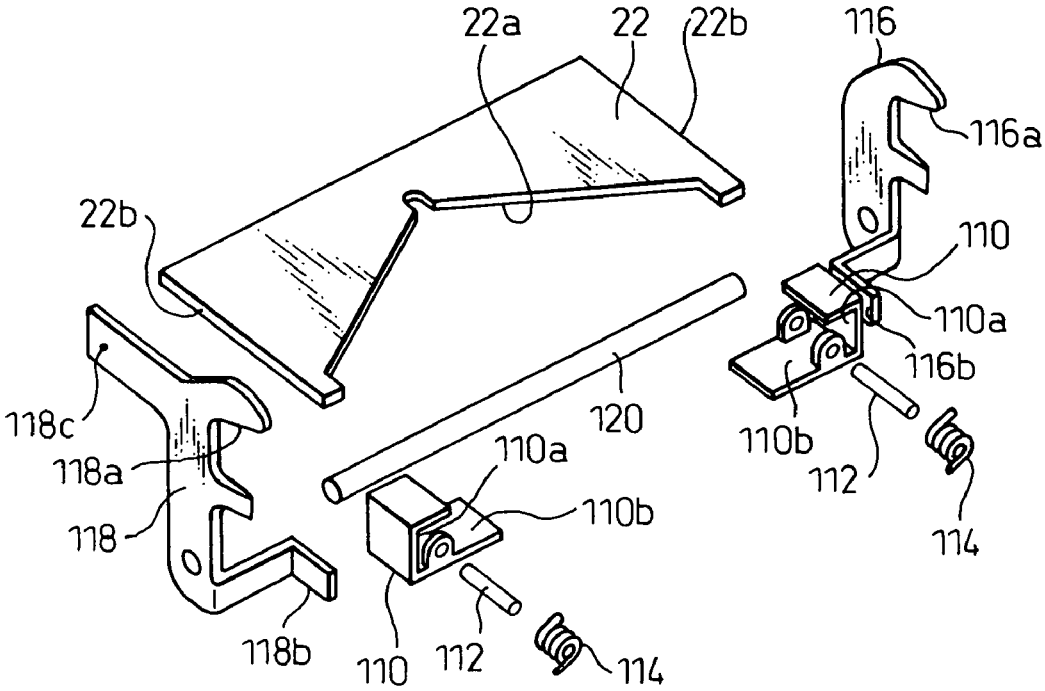
FIG. 14 is an exploded perspective view showing a movable blade guide.

In the printer 10, the movable blade 22 tends to be raised slightly in a region including the cutting edge 22*a* during a cutting operation, as has already been described, by the abutment of the fixed blade 20 against the movable blade 22 under the biasing force of the pushing member 98. Therefore, in order to precisely cut printing paper, it is desirable to prevent the movable blade 22 from rising in the edge region thereof as far as possible. To this end, the cutting section 14 may be further provided with a movable blade guide 110 (FIG. 14) for guiding the movable blade 22 along a predetermined path of movement, during a cutting operation by the movable blade 22 in the mutually-adjoining position. In particular, as shown in FIG. 14, a pair of movable blade guides 110, respectively having recesses 110*a* for receiving the opposite lateral ends 22*a* of the movable blade 22, may preferably be provided on the first support member 24 along the predetermined path of movement of the movable blade 22. In this arrangement, each of the movable blade guides 110 is disposed pivotably about a shaft 112 as a fulcrum, and is biased by an elastic element 114, such as a torsion coil spring, in such a direction that the movable blade 22 is inhibited from rising and deviating from the predetermined path of movement. According to this arrangement, the movable blade guides 110 act to prevent the movable blade 22 from rising in the region of cutting edge 22*a* during a cutting operation, so as to ensure mutual abutment of the movable blade 22 and the fixed blade 20 under pressure, and thereby the printing paper is precisely cut.

In the above-described arrangement, when printing paper is jammed in the cutting section 14, it is difficult to separate the second support member 26 from the first support member 24 unless the engaging condition between the movable blade 22 and the movable blade guide 110 is released. Thus, the cutting section 14 may be further provided with a release mechanism for forcibly displacing the movable blade guide 110 from a guide position for engagement with the movable blade 22 to a release position for release of the movable blade 22. In this connection, in the printer 10 as shown in FIG. 3, a pair of pivoted hooks 116, 118 for retaining the first support member 24 and the second support member 26 in a mutually closed condition are disposed in the vicinity of the first and third gear trains 64, 90 on the first support member 24, respectively. It is advantageous, from the viewpoint of reducing the number of parts, that the pivoted hooks 116, 118 also function as the release mechanism for the movable blade guides 110, as described below.

Figure 15:
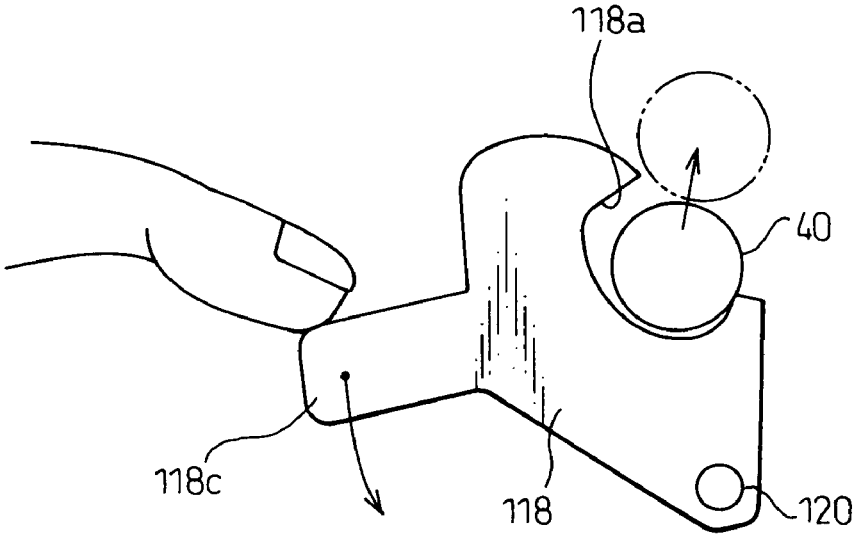
FIG. 15 diagrammatically shows an operation mode of a hooking element.

As shown in FIG. 14, the pivoted hooks 116, 118 are fixedly joined with each other through a link shaft 120, and are disposed pivotably about the link shaft 120 on the first support member 24. The pivoted hooks 116, 118 respectively include hook portions 116*a*, 118*a* capable of hooking on the shaft 40 of the platen 18 (FIG. 4) and extensions 116*b*, 118*b* extending away from the hook portions 116*a*, 118*a* about a center area fixed with the link shaft 120. One pivoted hook 118 further includes a lever portion 118*c* extending in back of the hook portion 118*a*. When an operator manually actuates the lever portion 118*c* of the pivoted hook 118 to pivot the pivoted hooks 116, 118 about the link shaft 120, the pivoted hooks 116, 118 are engaged with or disengaged from the platen shaft 40 on the hook portions 116*a*, 118*a* (see FIG. 15).

Each of the movable blade guides 110 is further provided with an extension 10*b* extending away from the recess 110*a* about a center area fixed with the shaft 112. The pivoted hooks 116, 118 are disposed such that the extensions 116*b*, 118*b* are abutted to the lower faces of the extensions 110*b* of the corresponding movable blade guides 110. In this state, each of the pivoted hooks 116, 118 receives, on the extension 116*b*, 118*b*, the biasing force of the elastic element 114 provided for the corresponding movable blade guide 110 through the extension 110*b* of the latter, and is thereby biased in a direction such that each hook portion 116*a*, 118*a* hooks on the platen shaft 40. Consequently, during a paper cutting process, the movable blade guides 110 act at the guide position thereof to guide the movable blade 22 along the predetermined path of movement, and simultaneously, the pivoted hooks 116, 118 are engaged with the platen shaft 40 to stably retain the second support member 26 in the closed condition. If the paper jamming condition is caused during the paper cutting operation, an operator manually actuates the lever portion 118*c* of the pivoted hook 118, so as to disengage the pivoted hooks 116, 118 from the platen shaft 40, and simultaneously to forcibly displace the movable blade guides 110 from the guide position to the release position. As a result, it is possible to easily separate the second support member 26 from the first support member 24.

It should be noted that the lever portion 118*c* of the pivoted hook 118 is shaped to be positioned such as to possibly interfere with the gear train of the drive mechanism provided in the second support member 26. In particular, in order to avoid the interference with the second gear train 66 of the movable blade drive mechanism, the pivoted hook 118 is disposed on the first support member 24 at a side away from the second gear train 66, as illustrated. In this respect, it may be required that the pivoted hook 118 having the lever portion 118*c* be disposed reversely to the illustrated embodiment due to, e.g., the structural limitation of an apparatus into which the printer 10 is incorporated. In this case, it is advantageous that motors having identical structures be used as the movable blade drive source 60 and the roller drive source 86, and that reduction gearings having identical structures be adopted for the first gear train 64 of the movable blade drive mechanism and the third gear train 90 of the platen drive mechanism. In other words, the third gear train 90 connected to the roller drive source 86 may advantageously be constructed substantially identical with the first gear train 64 connected to the movable blade drive source 60. According to this symmetrical arrangement, it is possible to exchange in a positional sense the second gear train 66 for the fourth gear train 94, both provided in the second support member 26, corresponding to the location of the pivoted hook 118 having the lever portion 118*c* on the first support member 24, without altering the configuration of components of the drive mechanisms provided for the printing section 12 and the cutting section 14 in the first support member 24.

Figure 16:
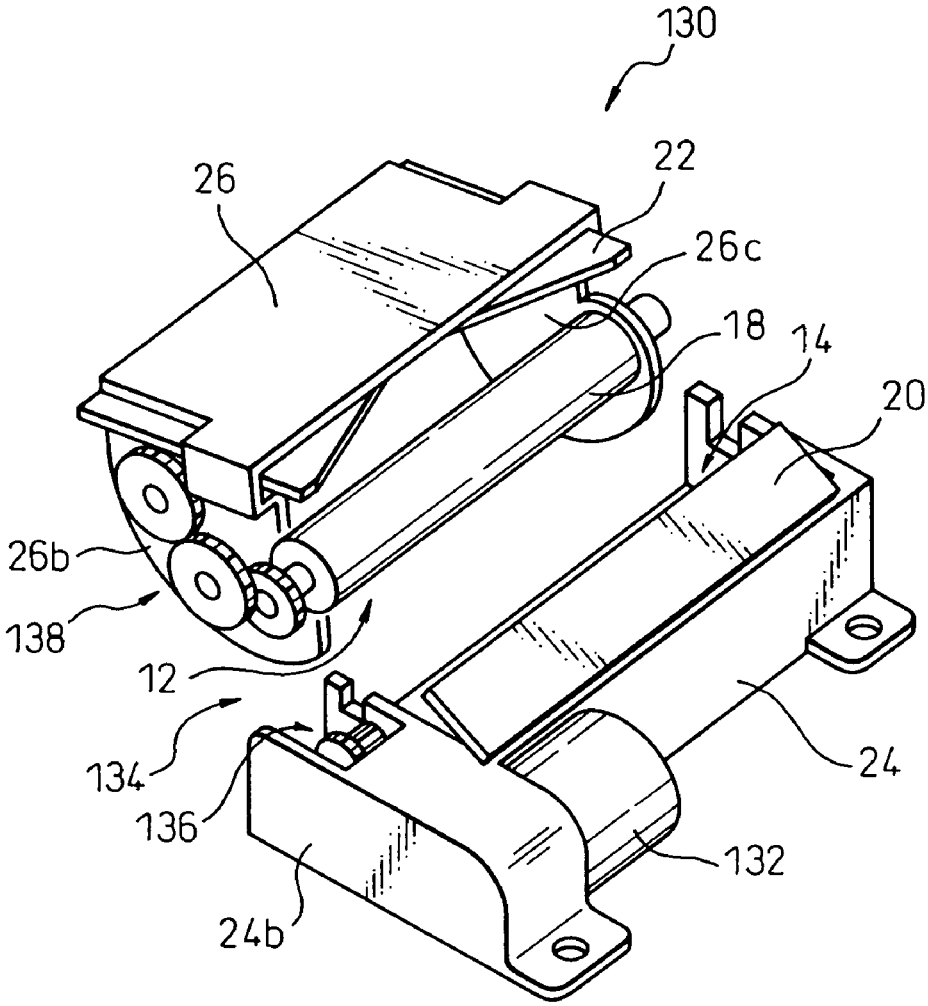
FIG. 16 is a perspective view showing a second embodiment of a printer according to the present invention.

The printer with automatic cutter according to the present invention may be constituted such that the movable blade drive mechanism and the platen drive mechanism have a common component. FIG. 16 schematically shows a printer 130, according to the second embodiment of the present invention, which is equipped with a unitary drive mechanism having as a common component. The printer 130 has substantially the same structure as that of the printer 10 explained above, except that the construction of the drive mechanism for the movable blade and for the platen. Therefore, components corresponding to those in the first embodiment are denoted by common reference numerals and explanations thereof are omitted.

The printer 130 includes a unitary drive source 132, such as a pulse motor, disposed on a first support member 24, which acts as a roller drive source for driving a platen 18 (i.e., a paper feed roller) of a printing section 12 for rotation and a movable blade drive source for driving a movable blade 22 of a cutting section 14 for cutting operation. The printer 130 also includes a power transmission mechanism 134 arranged to selectively transmit the driving force of the drive source 132 to one of the platen 18 and the movable blade 22 so as to alternatively cause one of a paper feeding operation by the platen 18 and a cutting operation by the movable blade 22. The power transmission mechanism 134 includes a first gear train 136 disposed on the first support member 24 and connected with the drive source 132 and a second gear train 138 disposed on the second support member 26 and connected with the platen 18 and the movable blade 22. The first gear train 136 and the second gear train 138 are connected with each other when the fixed blade 20 and the movable blade 22 are in the mutually-adjoining position, and are disconnected from each other as the fixed blade 20 and the movable blade 22 are shifted from the mutually-adjoining position to the mutually-remote position.

Figure 17:
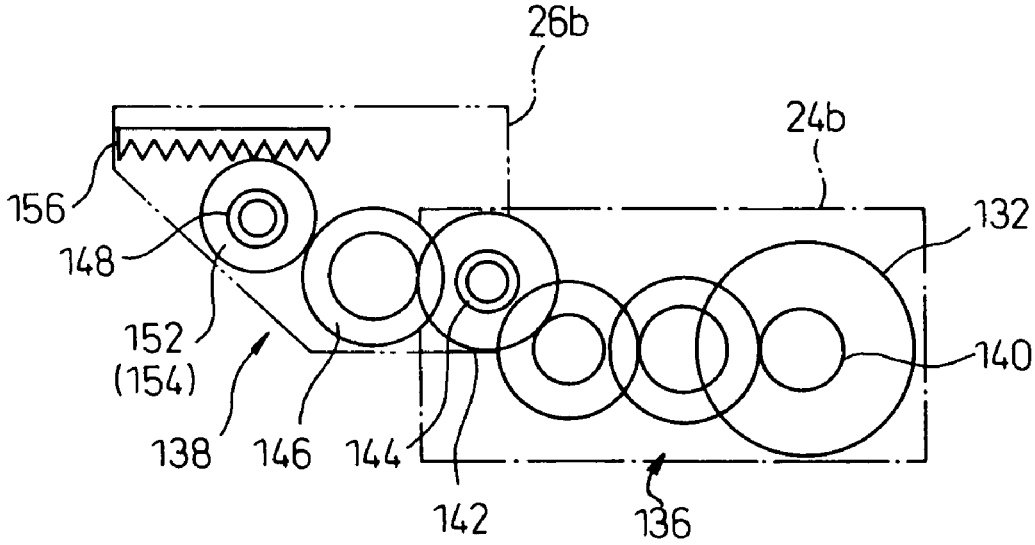
FIG. 17 diagrammatically shows a power transmission mechanism in the printer of FIG. 16.

As diagrammatically shown in FIG. 17, the first gear train 136 of the power transmission mechanism 134 includes a plurality of gears including a driving gear 140 fixed to the output shaft of the drive source 132, and is disposed alongside one side frame part 24*b* of the first support member 24 to transmit the output torque of the drive source 132 in a suitable reduction ratio. The second gear train 138 includes a plurality of gears including a driven gear 142 carried on the shaft 40 of the platen 18, and is disposed alongside one side frame part 26*b* of the second support member 26 to selectively transmit the torque, transmitted from the first gear train 136, to the platen 18 and the movable blade 22.

Figure 18:
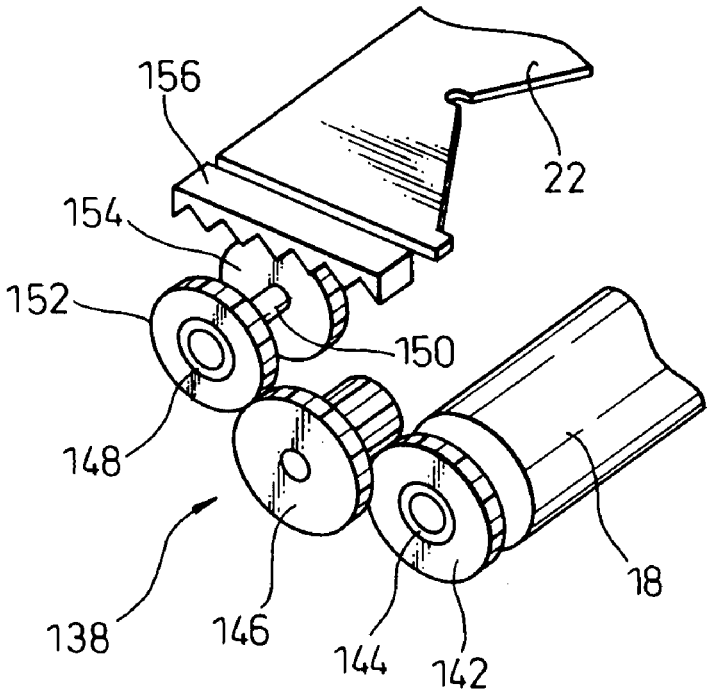
FIG. 18 is a perspective view schematically showing a second gear train in the power transmission mechanism of FIG. 17.

More specifically, as shown in FIG. 18, the second gear train 138 includes the first driven gear 142 mounted through a one-way clutch 144 on the platen shaft 40, an intermediate gear 146 engagable with the driven gear 142, a second driven gear 152 mounted through a one-way clutch 148 on a pinion shaft 150 and engagable with the intermediate gear 146, a first pinion 154 fixed to the pinion shaft 150, and a first rack 156 engagable with the first pinion 154. Although not shown, the second gear train 138 further includes a second pinion rotatable synchronously with the first pinion 154 and a second rack engagable with the second pinion, both disposed alongside the other side frame part 26*c* of the second support member 26, in a similar way as the movable blade drive mechanism in the printer 10.

In the above drive mechanism, the one-way clutch 144 arranged between the platen shaft 40 and the driven gear 142 and the one-way clutch 148 arranged between the pinion shaft 150 and the driven gear 152 are constructed such that, during a period when one is in a clutching condition, the other is in a releasing condition. One exemplary arrangement is as follows: at a time when the drive source 132 operates in a normal direction, the one-way clutch 144 for the platen 18 transmits the rotation of the driven gear 142 to the platen shaft 40 so as to rotate the platen 18 in a paper feeding direction, while the one-way clutch 148 for the pinion 154 idles the driven gear 152 on the pinion shaft 150. Then, at the time when the drive source 132 operates in a reverse direction, the one-way clutch 144 idles the driven gear 142 on the platen shaft 40, while the one-way clutch 148 transmits the rotation of the driven gear 152 to the pinion shaft 150 so as to move the movable blade 22 in a paper cutting direction under the cooperation of the pinion 154 and the rack 156. According to this arrangement, the driving force of the drive source 132 is transmitted on demand to either one of the platen 18 and the movable blade 22, so as to cause either one of a paper feeding operation by the platen 18 and a cutting operation by the movable blade 22.

In the above-described arrangement of the unitary drive mechanism, it is difficult to use the reverse operation of the drive source 132 for returning the movable blade 22 to the retraction or initial position after cutting printing paper. Thus, the printer 130 is provided with a movable blade returning mechanism for automatically returning the movable blade 22 to the retraction or initial position after cutting printing paper. As shown in FIGS. 19A to 19D, the movable blade returning mechanism is embodied by the pinion 154 having a no-tooth area over a predetermined central angle, an elastic member 158 for elastically biasing the rack 156 (or the movable blade 22) toward the retraction or initial position, and a stopper 160 for stopping the rack 156 (or the movable blade 22) at the retraction or initial position against the biasing force of the elastic member 158.

Figure 19A:
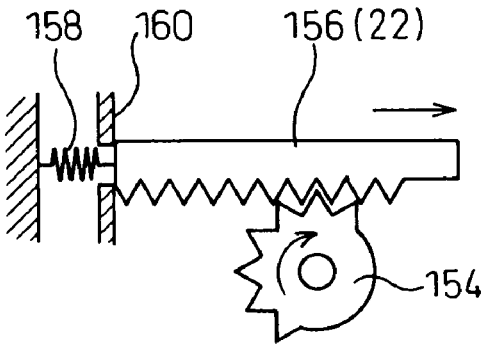
FIGS. 19A to 19D schematically show a movable blade returning mechanism in the printer of FIG. 16 in several states.
Figure 19B:
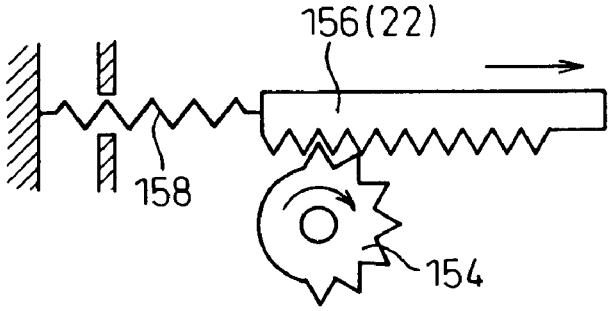
Figure 19C:
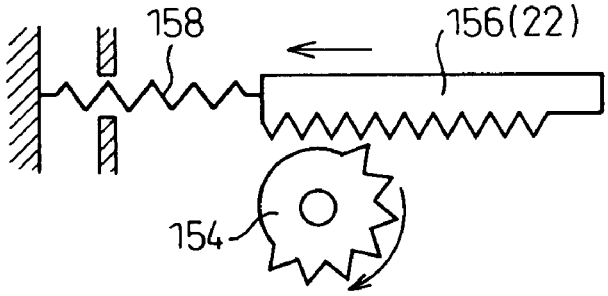
Figure 19D:
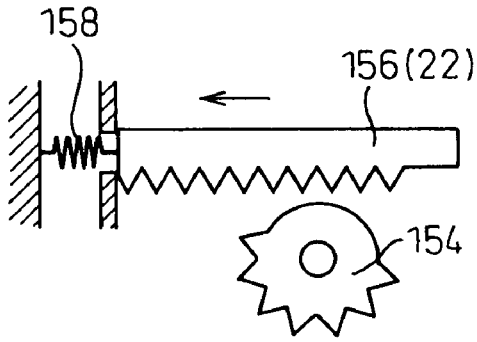

When the movable blade 22 is driven, the driving force of the drive source 132 in the reverse operation thereof causes rotation of the pinion 154 engaging with the rack 156 over a predetermined angle range, whereby the movable blade 22 moves in the paper cutting direction (FIGS. 19A and 19B). At the instant a cutting process is completed, the rotation angle of the pinion 154 exceeds the predetermined angle range and the pinion 154 and the rack 156 are disengaged from each other, so that the movable blade 22 automatically moves toward the retraction or initial position under the biasing force of the elastic member 158 (FIG. 19C). Then, the stopper 160 acts to retain the movable blade 22 at the retraction or initial position (FIG. 19D). It should be noted that when pinions having various no-tooth areas are provided for permitting suitable exchange thereof, it is possible to establish a dual-purpose arrangement selectable between a full-cut mode for fully cutting printing paper and a partial-cut mode for remaining a cut-free area in printing paper.

As is apparent from the above description, the printer with automatic cutter according to the present invention is provided with a built-in type cutting section, whereby it is possible to reduce the size of the printer, and to readily eliminate a paper jam in the cutting section without requiring a specific manual operation when printing paper is jammed between a fixed blade and a movable blade during a paper cutting process. Also, in the cutter according to the present invention, it is possible to readily eliminate a paper jam without requiring a specific manual operation.

While the invention has been described with particular reference to preferred embodiments thereof, it will be understood by those skilled in the art that various changes and modifications may be made without departing from the spirit and scope of the following claims.

The invention claimed is:

1. A printer, comprising:

a printing section printing on a printing paper fed continuously thereto;

a cutting section arranged downstream of said printing section in a paper feeding direction, said cutting section comprising;

a fixed blade and a movable blade which cooperate with each other to cut the printing paper, said fixed blade and said movable blade being shiftable relative to each other between a cooperative mutually-adjoining position and an uncooperative mutually-remote position, a power transmission mechanism transmitting the driving force of said drive source to said movable blade to move said movable blade, and wherein said power transmission mechanism includes a first gear train disposed on said first support member and connected with said drive source and a second gear train disposed on said second support member and connected with said movable blade, said first gear train being connected with said second gear train when said fixed blade and said movable blade are in said mutually-adjoining position, said first gear train being disconnected from said second gear train as said fixed blade and said movable blade are shifted from said mutually-adjoining position to said mutually-remote position, and an elastic member biasing said movable blade on said second support member toward a retraction position, and wherein said movable blade is operated for cutting by the driving force of said drive source against biasing force of said elastic member when said first gear train is connected with said second gear train, and is retracted into said retraction position under the biasing force of said elastic member when said first gear train is disconnected from said second gear train;

a support mechanism supporting said printing section and said cutting section, said support mechanism including a first support member supporting said fixed blade of said cutting section and a second support member supporting said movable blade of said cutting section, said first support member being fixedly arranged to specify an operative printing point in said printing section and said second support member being shiftably arranged relative to said first support member; and a drive source provided in said cutting section generating a driving force to move said movable blade on said second support member, said drive source being mounted on said first support member.

2. A printer as set forth in claim 1, further comprising a supplying section arranged upstream of said printing section in the paper feeding direction and receiving a printing paper in a continuously feedable manner, wherein said first support member is associated with a stationary base carrying the printing paper received in said supplying section, and wherein said second support member is associated with a shiftable cover joined relatively shiftably with said stationary base and cooperating with said stationary base to define a paper receiving space in said supplying section.

3. A printer as set forth in claim 1, wherein said second gear train includes a pair of pinions rotatable synchronously with each other, said pinions being disposed alongside opposite lateral ends of said movable blade to transmit the driving force to said lateral ends.

4. A printer as set forth in claim 3, wherein said second gear train includes a pair of racks engagable respectively with said pair of pinions, said racks being secured to said lateral ends to cover local surface areas of said movable blade.

5. A printer as set forth in claim 1, wherein said printing section is provided with a paper feed roller disposed on said second support member, a second drive source disposed on said first support member, independently from said drive source for said movable blade, rotationally driving said paper feed roller on said second support member, and a second power transmission mechanism transmitting driving force of said second drive source to said paper feed roller, and wherein said second power transmission mechanism includes a third gear train disposed on said first support member and connected with said second drive source and a fourth gear train disposed on said second support member and connected with said paper feed roller, said third gear train being constructed substantially identical with said first gear train.

6. A printer as set forth in claim 1, wherein said printing section is provided with a paper feed roller disposed on said second support member, and wherein said power transmission mechanism is arranged to selectively transmit the driving force of said drive source to one of said movable blade and said paper feed roller to alternatively cause a cutting operation by said movable blade and a feeding operation by said paper feed roller.

7. A printer as set forth in claim 1, wherein said cutting section is further provided with a sensor sensing a location of said movable blade in relation to said fixed blade in said mutually-adjoining position, and a controller controlling said drive source in accordance with a sensing signal of said sensor.

8. A printer as set forth in claim 1, wherein said cutting section is further provided with a pushing member elastically pushing said fixed blade on said first support member in a direction such that said fixed blade is abutted to said movable blade.

9. A printer as set forth in claim 1, wherein said cutting section is further provided with a movable blade guide guiding said movable blade along a predetermined path during a cutting operation by said movable blade in said mutually-adjoining position.

10. A printer as set forth in claim 9, wherein said movable blade guide is disposed on said first support member, and wherein said cutting section is further provided with a release mechanism forcibly displacing said movable blade guide from a guide position for engagement with said movable blade to a release position for release of said movable blade.

11. A printer as set forth in claim 1, wherein said fixed blade is located upstream of said movable blade in the paper feeding direction when said movable blade and said fixed blade are in said mutually-adjoining position.

12. A cutter, comprising:

a fixed blade and a movable blade, which cooperate with each other to cut a printing paper, said fixed blade and said movable blade being shiftable relative to each other between a cooperative mutually-adjoining position and an uncooperative mutually-remote position;

a first support member supporting said fixed blade and fixedly arranged in association with a supply source of the printing paper;

a second support member supporting said movable blade and shiftably arranged relative to said first support member;

a drive source generating a driving force to move said movable blade on said second support member, said drive source being mounted on said first support member;

a power transmission mechanism transmitting the driving force of said drive source to said movable blade to move said movable blade, wherein said power transmission mechanism includes a first gear train disposed on said first support member and connected with said drive source and a second gear train disposed on said second support member and connected with said movable blade, said first gear train being connected with said second gear train when said fixed blade and said movable blade are in said mutually-adjoining position, said first gear train being disconnected from said second gear train as said fixed blade and said movable blade are shifted from said mutually-adjoining position to said mutually-remote position; and an elastic member biasing said movable blade on said second support member toward a retraction position, and wherein said movable blade is operated for cutting by the driving force of said drive source against biasing force of said elastic member when said first gear train is connected with said second gear train, and is retracted into said retraction position due to the biasing force of said elastic member when said first gear train is disconnected from said second gear train.

13. A cutter as set forth in claim 12, incorporated in a printer provided with a printing section, wherein said first support member is capable of being fixedly arranged to specify an operative printing point in said printing section.

14. A cutter as set forth in claim 13, wherein said printer is further provided with a supplying section arranged upstream of said printing section in a paper feeding direction, wherein said first support member is capable of being associated with a stationary base carrying the printing paper in said supplying section, and wherein said second support member is capable of being associated with a shiftable cover joined relatively shiftably with said stationary base and cooperating with said stationary base to define a paper receiving space in said supplying section.

15. A printer, comprising:

a printing section printing on a printing paper fed continuously thereto;

a cutting section arranged downstream of said printing section in a paper feeding direction, said cutting section comprising:

a fixed blade and a movable blade which cooperate with each other to cut the printing paper, said fixed blade and said movable blade being shiftable relative to each other between a cooperative mutually-adjoining position and an uncooperative mutually-remote position, a support mechanism supporting said printing section and said cutting section, said support mechanism including a first support member supporting said fixed blade of said cutting section and a second support member supporting said movable blade of said cutting section, said first support member being fixedly arranged to specify an operative printing point in said printing section and said second support member being shiftably arranged relative to said first support member, and a power transmission mechanism transmitting the driving force of said drive source to said movable blade to move said movable blade, and wherein said power transmission mechanism includes a first gear train disposed on said first support member and connected with said drive source and a second gear train disposed on said second support member and connected with said movable blade, said first gear train being connected with said second gear train when said fixed blade and said movable blade are in said mutually-adjoining position, said first gear train being disconnected from said second gear train as said fixed blade and said movable blade are shifted from said mutually-adjoining position to said mutually-remote position, said second gear train including a pair of pinions rotatable synchronously with each other, said pinions being disposed alongside opposite lateral ends of said movable blade to transmit the driving force to said lateral ends; and a drive source provided in said cutting section generating a driving force to move said movable blade on said second support member, said drive source being mounted on said first support member.

16. A printer as set forth in claim 15, wherein said second gear train includes a pair of racks engagable respectively with said pair of pinions, said racks being secured to said lateral ends to cover local surface areas of said movable blade.

17. A printer, comprising:

a printing section printing on a printing paper fed continuously thereto;

a cutting section arranged downstream of said printing section in a paper feeding direction, said cutting section comprising:

a fixed blade and a movable blade which cooperate with each other to cut the printing paper, said fixed blade and said movable blade being shiftable relative to each other between a cooperative mutually-adjoining position and an uncooperative mutually-remote position, a support mechanism supporting said printing section and said cutting section, said support mechanism including a first support member supporting said fixed blade of said cutting section and a second support member supporting said movable blade of said cutting section, said first support member being fixedly arranged to specify an operative printing point in said printing section and said second support member being shiftably arranged relative to said first support member, a power transmission mechanism transmitting the driving force of said drive source to said movable blade to move said movable blade, and wherein said power transmission mechanism includes a first gear train disposed on said first support member and connected with said drive source and a second gear train disposed on said second support member and connected with said movable blade, said first gear train being connected with said second gear train when said fixed blade and said movable blade are in said mutually-adjoining position, said first gear train being disconnected from said second gear train as said fixed blade and said movable blade are shifted from said mutually-adjoining position to said mutually-remote position; and a drive source provided in said cutting section generating a driving force to move said movable blade on said second support member, said drive source being mounted on said first support member, wherein said printing section is provided with a paper feed roller disposed on said second support member, a second drive source disposed on said first support member, independently from said drive source for said movable blade, rotationally driving said paper feed roller on said second support member, and a second power transmission mechanism transmitting a driving force of said second drive source to said paper feed roller, and wherein said second power transmission mechanism includes a third gear train disposed on said first support member and connected with said second drive source and a fourth gear train disposed on said second support member and connected with said paper feed roller, said third gear train being constructed substantially identical with said first gear train.

18. A printer, comprising:

a printing section printing on a printing paper fed continuously thereto;

a cutting section arranged downstream of said printing section in a paper feeding direction, said cutting section comprising:

a fixed blade and a movable blade which cooperate with each other to cut the printing paper, said fixed blade and said movable blade being shiftable relative to each other between a cooperative mutually-adjoining position and an uncooperative mutually-remote position, a support mechanism supporting said printing section and said cutting section, said support mechanism including a first support member supporting said fixed blade of said cutting section and a second support member supporting said movable blade of said cutting section, said first support member being fixedly arranged to specify an operative printing point in said printing section and said second support member being shiftably arranged relative to said first support member, and a power transmission mechanism transmitting the driving force of said drive source to said movable blade to move said movable blade, and wherein said power transmission mechanism includes a first gear train disposed on said first support member and connected with said drive source and a second gear train disposed on said second support member and connected with said movable blade, said first gear train being connected with said second gear train when said fixed blade and said movable blade are in said mutually-adjoining position, said first gear train being disconnected from said second gear train as said fixed blade and said movable blade are shifted from said mutually-adjoining position to said mutually-remote position; and a drive source provided in said cutting section generating a driving force to move said movable blade on said second support member, said drive source being mounted on said first support member, wherein said printing section is provided with a paper feed roller disposed on said second support member, and wherein said power transmission mechanism is arranged to selectively transmit the driving force of said drive source to one of said movable blade and said paper feed roller to alternatively cause a cutting operation by said movable blade and a feeding operation by said paper feed roller.

19. A printer, comprising:

a printing section printing on a printing paper fed continuously thereto;

a cutting section arranged downstream of said printing section in a paper feeding direction, said cutting section including a fixed blade and a movable blade which cooperate with each other to cut the printing paper, said fixed blade and said movable blade being shiftable relative to each other between a cooperative mutually-adjoining position and an uncooperative mutually-remote position and a movable blade guide for guiding said movable blade along a predetermined path during a cutting operation by said movable blade in said mutually-adjoining position;

a support mechanism for supporting said printing section and said cutting section, said support mechanism including a first support member supporting said fixed blade of said cutting section and a second support member supporting said movable blade of said cutting section, said first support member being fixedly arranged to specify an operative printing point in said printing section and said second support member being shiftably arranged relative to said first support member;

said movable blade guide being disposed on said first support member, and said cutting section being further provided with a release mechanism for forcibly displacing said movable blade guide from a guide position for engagement with said movable blade to a release position for release of said movable blade; and a drive source provided in said cutting section generating a driving force to move said movable blade on said second support member, said drive source being mounted on said first support member.

* * * * *

UNITED STATES PATENT AND TRADEMARK OFFICE

CERTIFICATE OF CORRECTION

PATENT NO. : 7,059,793 B2
APPLICATION NO. : 10/765922
DATED : June 13, 2006
INVENTOR(S) : Yukihiro Mori et al.

It is certified that error appears in the above-identified patent and that said Letters Patent is hereby corrected as shown below:

Column 19, line 33 in Claim 1, after “comprising” delete “;” and insert --:--

Signed and Sealed this

Thirtieth Day of January, 2007

JON W. DUDAS
*Director of the United States Patent and Trademark Office*